US010952544B2

(12) United States Patent
Sclare et al.

(10) Patent No.: US 10,952,544 B2
(45) Date of Patent: Mar. 23, 2021

(54) CHILD SUPPORT DEVICE

(71) Applicant: KIDS II, INC., Atlanta, GA (US)

(72) Inventors: Jacob Sclare, Dacula, GA (US); Chaitanya Tadipatri, Alpharetta, GA (US); Eric A. Lange, Alpharetta, GA (US); John Matthew Thomson, Johns Creek, GA (US)

(73) Assignee: KIDS2, INC., Atlanta, GA (US)

( * ) Notice: Subject to any disclaimer, the term of this patent is extended or adjusted under 35 U.S.C. 154(b) by 638 days.

(21) Appl. No.: 15/415,225

(22) Filed: Jan. 25, 2017

(65) Prior Publication Data

US 2017/0196373 A1 Jul. 13, 2017

Related U.S. Application Data

(63) Continuation-in-part of application No. 15/082,680, filed on Mar. 28, 2016, now abandoned.

(Continued)

(51) Int. Cl.

*A47D 13/00* (2006.01)
*A47D 11/00* (2006.01)

(Continued)

(52) U.S. Cl.

CPC ..... *A47D 11/007* (2013.01); *A47D 5/00* (2013.01); *A47D 7/005* (2013.01); *A47D 7/04* (2013.01);

(Continued)

(58) Field of Classification Search

CPC ..... A47D 13/00; A47D 13/06; A47D 13/061; A47D 13/063; A47D 13/066;

(Continued)

(56) References Cited

U.S. PATENT DOCUMENTS 116,073 A 6/1871 Maschmann
162,153 A 4/1875 Clark (Continued)

FOREIGN PATENT DOCUMENTS

AU 715883 B3 2/2000
DE 2856168 A1 7/1980

(Continued)

OTHER PUBLICATIONS

Arm's Reach Universal Co-Sleeper Bassinet; Arm's Reach Concepts, Inc.; 2001; 8 pgs.

(Continued)

*Primary Examiner* — Robert G Santos
*Assistant Examiner* — Ifeolu A Adeboyejo
(74) *Attorney, Agent, or Firm* — Gardner Groff & Greenwald, PC

(57) ABSTRACT

A child support system for infants or small children. The child support system includes a child containment device and at least one child support unit detachably mounted to the child containment device. The child containment device includes a frame, liner and, optionally, a raised bassinet mattress. The at least one child support unit may take the form of a bassinet, sleeper, seat, and/or a changing table. The child containment device frame can be collapsible for storage and transport. The child support unit can be configured for use in different modes, in combination with, and/or independent of the child containment device.

13 Claims, 15 Drawing Sheets

Related U.S. Application Data

(60) Provisional application No. 62/139,994, filed on Mar. 30, 2015, provisional application No. 62/287,100, filed on Jan. 26, 2016.

(51) Int. Cl.

| | |
|---|---|
| ***A47D 5/00*** | (2006.01) |
| ***A47D 9/04*** | (2006.01) |
| ***A47D 13/06*** | (2006.01) |
| ***A47D 7/04*** | (2006.01) |
| ***A47D 9/00*** | (2006.01) |
| ***A47D 7/00*** | (2006.01) |

(52) U.S. Cl.
CPC ..... *A47D 9/00* (2013.01); *A47D 9/04* (2013.01); *A47D 13/06* (2013.01); *A47D 13/063* (2013.01)

(58) Field of Classification Search
CPC ..... A47D 13/068; A47D 5/00; A47D 9/00; A47D 9/005; A47D 7/00; A47D 7/007; A47D 7/002
See application file for complete search history.

(56) References Cited

U.S. PATENT DOCUMENTS

| | | | |
|---|---|---|---|
| 417,839 | A | 12/1889 | Richardson |
| 485,081 | A | 10/1892 | Baird |
| 548,901 | A | 10/1895 | Welch |
| 1,057,360 | A | 3/1913 | Patten |
| 1,183,819 | A | 5/1916 | Keiser |
| 1,288,347 | A | 12/1918 | Wilson |
| 1,374,333 | A | 4/1921 | Stotler et al. |
| 1,391,650 | A | 9/1921 | Truesdell et al. |
| 1,427,598 | A | 8/1922 | Jackson |
| 1,493,505 | A | 5/1924 | Smith |
| 1,512,522 | A | 10/1924 | Colburn |
| 1,545,446 | A | 7/1925 | Paulet |
| 1,557,263 | A | 10/1925 | Millen |
| 1,658,944 | A | 2/1928 | Schaeffer |
| 1,724,479 | A | 8/1929 | Havener |
| 1,794,561 | A | 3/1931 | Taylor |
| 1,812,971 | A | 7/1931 | McCandless |
| 1,827,687 | A | 10/1931 | McCandless |
| 2,280,913 | A | 4/1942 | Hummel et al. |
| 2,287,907 | A | 6/1942 | Schettler, Jr. |
| 2,327,671 | A | 8/1943 | Rupprecht |
| 2,423,402 | A | 7/1947 | Olsen |
| 2,478,004 | A | 8/1949 | Newell |
| 2,590,315 | A | 3/1952 | Hawley, Jr. |
| 2,595,532 | A | 5/1952 | Leitner |
| 2,614,264 | A | 10/1952 | Schmidt, Jr. |
| 2,655,198 | A | 10/1953 | Williams et al. |
| 2,659,903 | A | 11/1953 | Hagelfeldt |
| 2,752,614 | A | 7/1956 | Hayward |
| 2,784,420 | A | 3/1957 | Moltane |
| 2,790,978 | A | 5/1957 | Tigrett |
| 2,831,199 | A | 4/1958 | Stanley |
| 2,948,287 | A | 8/1960 | Rupert |
| 3,078,478 | A | 2/1963 | Sheahan |
| 3,135,970 | A | 6/1964 | Trent et al. |
| 3,223,098 | A | 12/1965 | Dole, Jr. |
| 3,273,862 | A | 9/1966 | Miller |
| 3,427,666 | A | 2/1969 | Saxe |
| 3,495,794 | A | 2/1970 | Polk, Jr. |
| 3,644,947 | A | 2/1972 | Padera |
| 3,658,025 | A | 4/1972 | Hood et al. |
| 3,735,430 | A | 5/1973 | Platz |
| 3,848,277 | A | 11/1974 | Reguitti |
| 3,875,623 | A | 4/1975 | Johnston |
| 3,924,280 | A | 12/1975 | Vaiano |
| 4,018,260 | A | 4/1977 | Baslow |
| 4,105,244 | A | 8/1978 | Colby |
| 4,561,138 | A | 12/1985 | Hwang |
| 4,844,452 | A | 7/1989 | Tomosky et al. |
| 4,848,843 | A | 7/1989 | Gibbs |
| 4,967,432 | A | 11/1990 | Kujawski et al. |
| 5,092,001 | A | 3/1992 | Ross et al. |
| 5,163,191 | A | 11/1992 | Chan |
| 5,339,470 | A | 8/1994 | Shamie |
| 5,349,709 | A | 9/1994 | Cheng |
| 5,446,934 | A | 9/1995 | Frazier |
| 5,553,336 | A | 9/1996 | Mariol |
| 5,613,543 | A | 3/1997 | Walton |
| 5,778,465 | A | 7/1998 | Myers |
| 5,845,349 | A | 12/1998 | Tharalson et al. |
| 5,867,850 | A | 2/1999 | Mariol |
| 5,911,478 | A | 6/1999 | Goodman |
| 5,918,329 | A | 7/1999 | Huang |
| 5,991,944 | A | 11/1999 | Yang |
| 5,992,348 | A | 11/1999 | Harding |
| 6,004,182 | A | 12/1999 | Pasin |
| 6,076,448 | A | 6/2000 | Rexroad |
| 6,098,217 | A | 8/2000 | Hammil |
| 6,131,218 | A | 10/2000 | Wang |
| 6,158,067 | A | 12/2000 | Cheng |
| 6,173,462 | B1 | 1/2001 | Huang et al. |
| 6,192,535 | B1 | 2/2001 | Warner, Jr. et al. |
| 6,233,759 | B1 | 5/2001 | Warner, Jr. et al. |
| 6,293,624 | B1 | 9/2001 | Gaylord et al. |
| 6,332,231 | B1 | 12/2001 | Wang |
| 6,370,714 | B1 | 4/2002 | Elzenbeck |
| 6,402,116 | B1 | 6/2002 | Northup |
| 6,418,575 | B1 | 7/2002 | Cheng |
| 6,434,767 | B1 | 8/2002 | Welsh, Jr. |
| 6,511,562 | B1 | 1/2003 | Coffield |
| 6,526,608 | B1 | 3/2003 | Hsia |
| 6,539,563 | B1 | 4/2003 | Hsia |
| 6,543,070 | B2 | 4/2003 | Longenecker et al. |
| 6,554,747 | B1 | 4/2003 | Rempe |
| 6,560,827 | B1 | 5/2003 | Gross |
| 6,585,323 | B2 | 7/2003 | Gaylord et al. |
| 6,623,079 | B2 | 9/2003 | Gregory |
| 6,735,796 | B2 | 5/2004 | Warner, Jr. et al. |
| 6,742,523 | B2 | 6/2004 | Dubats |
| 6,779,849 | B1 | 8/2004 | Harper et al. |
| D500,213 | S | 12/2004 | DeHart et al. |
| 6,942,487 | B2 | 9/2005 | Corbalis |
| 6,948,197 | B1 | 9/2005 | Chen |
| 6,952,849 | B2 | 10/2005 | Pacella |
| 6,954,949 | B1 | 10/2005 | Chen |
| 6,961,968 | B2 | 11/2005 | Clapper et al. |
| D518,320 | S | 4/2006 | DeHart et al. |
| 7,063,096 | B2 | 6/2006 | Stoeckler |
| 7,111,339 | B2 | 9/2006 | Chen |
| 7,228,575 | B2 | 6/2007 | Chen |
| 7,263,729 | B2 | 9/2007 | Paesang et al. |
| 7,346,943 | B2 | 3/2008 | Chen |
| 7,404,219 | B2 | 7/2008 | Berkey |
| 7,418,745 | B2 | 9/2008 | Paesang et al. |
| 7,458,114 | B2 | 12/2008 | Troutman |
| 7,509,694 | B2 | 3/2009 | Chen |
| 7,568,242 | B2 | 8/2009 | Troutman |
| 7,581,269 | B2 | 9/2009 | Chen et al. |
| 7,908,686 | B2 | 3/2011 | Clapper et al. |
| 7,937,790 | B2 | 5/2011 | Zhao et al. |
| 7,950,081 | B2 | 5/2011 | Chen et al. |
| 8,001,630 | B2 | 8/2011 | Burkholder et al. |
| 8,006,326 | B2 | 8/2011 | Thomas et al. |
| 8,011,036 | B2 | 9/2011 | Tuckey |
| 8,028,358 | B2 | 10/2011 | Fiore, Jr. |
| 8,201,291 | B2 | 6/2012 | Burns et al. |
| 8,230,536 | B2 | 7/2012 | Clapper et al. |
| 8,281,431 | B2 | 10/2012 | Hartenstine |
| 8,291,530 | B2 | 10/2012 | Burkholder et al. |
| 8,307,475 | B2 | 11/2012 | Hutchinson et al. |
| 8,316,481 | B2 | 11/2012 | Arnold, IV et al. |
| 8,316,483 | B2 | 11/2012 | Thomas et al. |
| 8,321,973 | B2 | 12/2012 | Bickley |
| 8,387,807 | B2 | 3/2013 | Chen et al. |
| 8,522,374 | B2 | 9/2013 | Sousa et al. |
| 8,544,125 | B2 | 10/2013 | Greger et al. |
| D698,592 | S | 2/2014 | Rivera et al. |

(56) References Cited

U.S. PATENT DOCUMENTS

| | | | | |
|---|---|---|---|---|
| D700,466 | S | 3/2014 | Rivera et al. | |
| 8,677,533 | B2 | 3/2014 | Barron et al. | |
| 8,739,331 | B2 | 6/2014 | Gillett et al. | |
| 8,769,738 | B2 | 7/2014 | Horst et al. | |
| 8,806,673 | B2 | 8/2014 | Burkholder et al. | |
| D717,576 | S | 11/2014 | Tan | |
| 8,893,325 | B2 | 11/2014 | Arnold, IV et al. | |
| 8,925,128 | B2 | 1/2015 | Fiore, Jr. et al. | |
| 8,943,622 | B2 | 2/2015 | Saint et al. | |
| 8,997,277 | B2 | 4/2015 | Thomas et al. | |
| 9,066,607 | B1 | 6/2015 | Ransil et al. | |
| 9,066,610 | B2 | 6/2015 | Duan | |
| 9,078,530 | B2 | 7/2015 | Ingram et al. | |
| 9,089,225 | B2 | 7/2015 | Fiore, III et al. | |
| 9,101,226 | B1 | 8/2015 | Hartenstine et al. | |
| 9,179,786 | B1 | 11/2015 | Ransil et al. | |
| 9,198,524 | B2 | 12/2015 | Horst et al. | |
| 9,351,586 | B2 | 5/2016 | Burkholder et al. | |
| 9,351,587 | B2 | 5/2016 | Burns et al. | |
| 9,351,588 | B2 | 5/2016 | Burns et al. | |
| 9,364,098 | B2 | 6/2016 | Fiore, III et al. | |
| 9,375,095 | B2 | 6/2016 | Fiore, Jr. et al. | |
| 9,414,694 | B2 | 8/2016 | Arnold, IV et al. | |
| 9,585,493 | B2 | 3/2017 | Haut et al. | |
| 2001/0001162 | A1 | 5/2001 | Warner, Jr. et al. | |
| 2001/0001330 | A1 | 5/2001 | Warner, Jr. et al. | |
| 2003/0177575 | A1 | 9/2003 | Cheng et al. | |
| 2005/0150053 | A1 | 7/2005 | Hartenstine | |
| 2006/0080776 | A1 | 4/2006 | Clapper et al. | |
| 2006/0218725 | A1 | 10/2006 | Carpenter et al. | |
| 2006/0225204 | A1 | 10/2006 | Bretschger et al. | |
| 2007/0061961 | A1 | 3/2007 | Shamie | |
| 2007/0204403 | A1 | 9/2007 | Hartenstine | |
| 2007/0204404 | A1 | 9/2007 | Hartenstine | |
| 2008/0127412 | A1 | 6/2008 | Pleiman et al. | |
| 2010/0138991 | A1 | 6/2010 | Hartenstine et al. | |
| 2010/0229301 | A1* | 9/2010 | Arnold, IV | A47D 7/04 5/93.2 |
| 2011/0148159 | A1 | 6/2011 | Barron et al. | |
| 2011/0308011 | A1* | 12/2011 | Cheng | A47D 7/04 5/93.1 |
| 2013/0086750 | A1 | 4/2013 | Cheng | |
| 2013/0125304 | A1 | 5/2013 | DeHart et al. | |
| 2014/0191173 | A1 | 7/2014 | Saint et al. | |
| 2015/0216321 | A1* | 8/2015 | Hartenstine | A47D 5/006 5/11 |
| 2016/0227939 | A1* | 8/2016 | Tadipatri | A47D 9/02 |
| 2016/0286978 | A1 | 10/2016 | Sclare et al. | |
| 2016/0345748 | A1 | 12/2016 | Arnold, IV et al. | |
| 2017/0367495 | A1* | 12/2017 | Yu | A47C 31/00 |

FOREIGN PATENT DOCUMENTS

| | | | |
|---|---|---|---|
| DE | 8705939 | U1 | 9/1987 |
| DE | 4327819 | A1 | 2/1994 |
| DE | 29713646 | U1 | 2/1998 |
| DE | 20000537 | U1 | 8/2000 |
| EP | 1878364 | A1 | 1/2008 |
| EP | 2710930 | A2 | 3/2014 |
| EP | 2868235 | A1 | 5/2015 |
| FR | 564019 | A | 12/1923 |
| FR | 1193975 | A | 11/1959 |
| FR | 2593369 | A1 | 7/1987 |
| FR | 2775569 | A1 | 9/1999 |
| FR | 2913576 | A1 | 9/2008 |
| GB | 669243 | A | 4/1952 |
| GB | 1015096 | A | 12/1965 |
| GB | 1123434 | A | 8/1968 |
| GB | 1360375 | A | 7/1974 |
| GB | 2330070 | A | 4/1999 |
| GB | 2365334 | A | 2/2002 |
| JP | 2013240723 | A | 12/2013 |
| WO | 2013003320 | A2 | 1/2013 |

OTHER PUBLICATIONS

Baby Trend Model #: 8207BCC Deluxe Trend Nursery Center Instruction Manual; Baby Trend Inc.; 2006; 11 pgs.

Century Care Center Fold 'n Go Instruction Manual; Century Products; 2000; 12 pgs.

Chicago Tribune Display Ad 167; Jul. 27, 1978; 1 pg.

Keder—An Education on it's Design & Use; J & J Carter Limited; 2013; 6 pgs.

Kolcraft Travelin Tot Playard Series Instruction Sheet; Kolcraft Enterprises, Inc.; 2006; 22 pgs.

Los Angeles Times Display Ad 76; Mar. 4, 1971; 1 pg.

Extended European Search Report for EP App. No. 17153408.4; dated Jun. 9, 2017; 10 pgs.

* cited by examiner

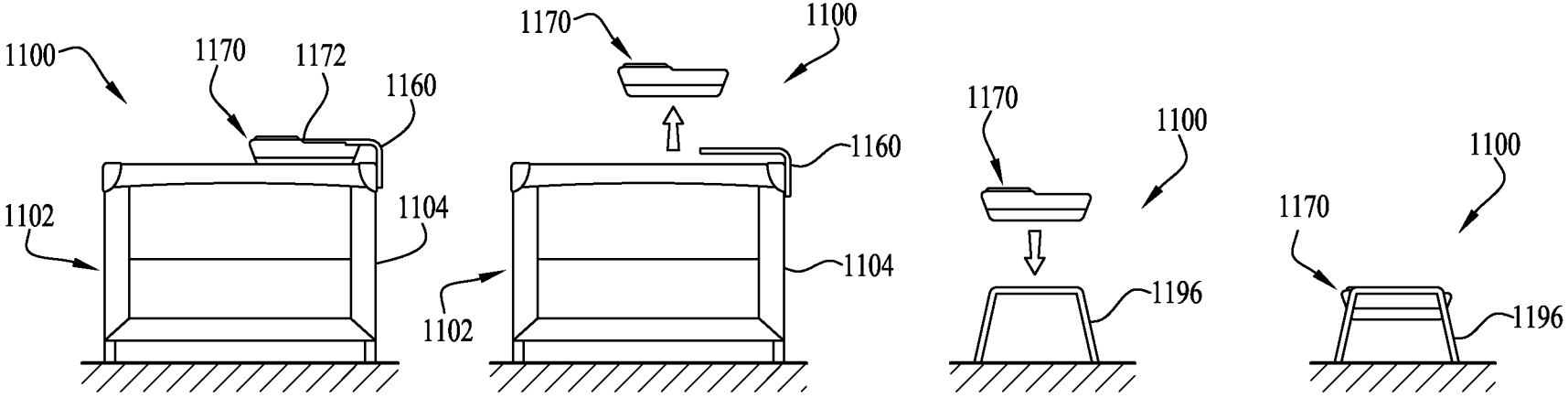
FIG. 17A
FIG. 17B
FIG. 17C
FIG. 17D
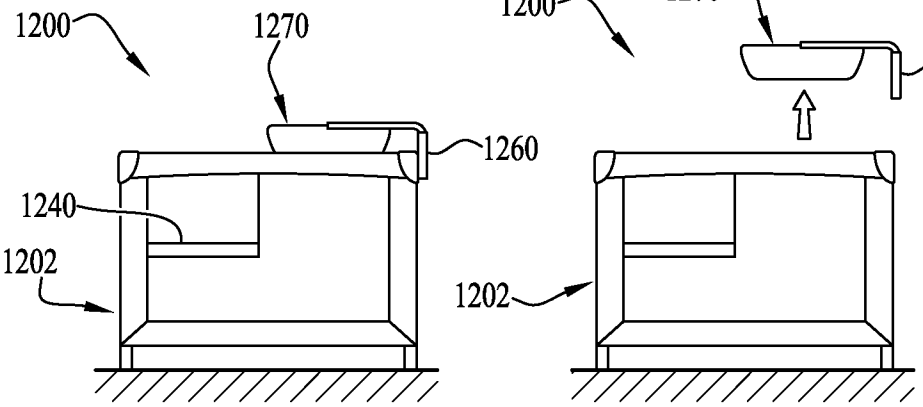
FIG. 18A
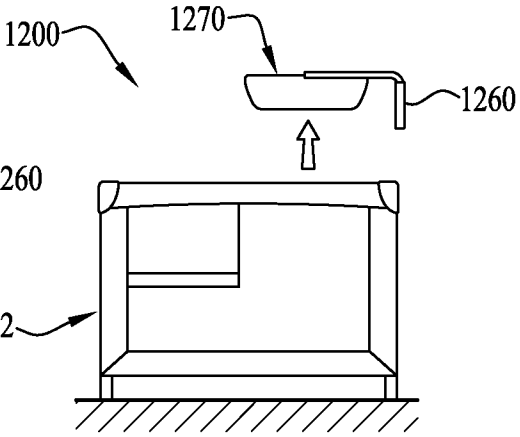
FIG. 18B
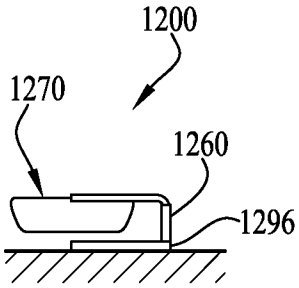
FIG. 18C

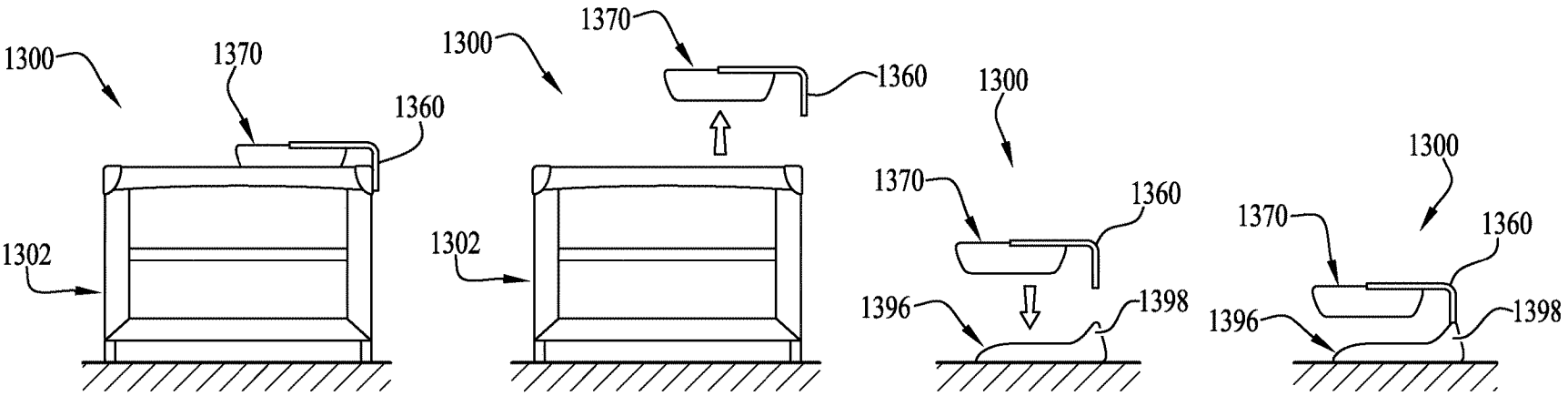
FIG. 19A
FIG. 19B
FIG. 19C
FIG. 19D
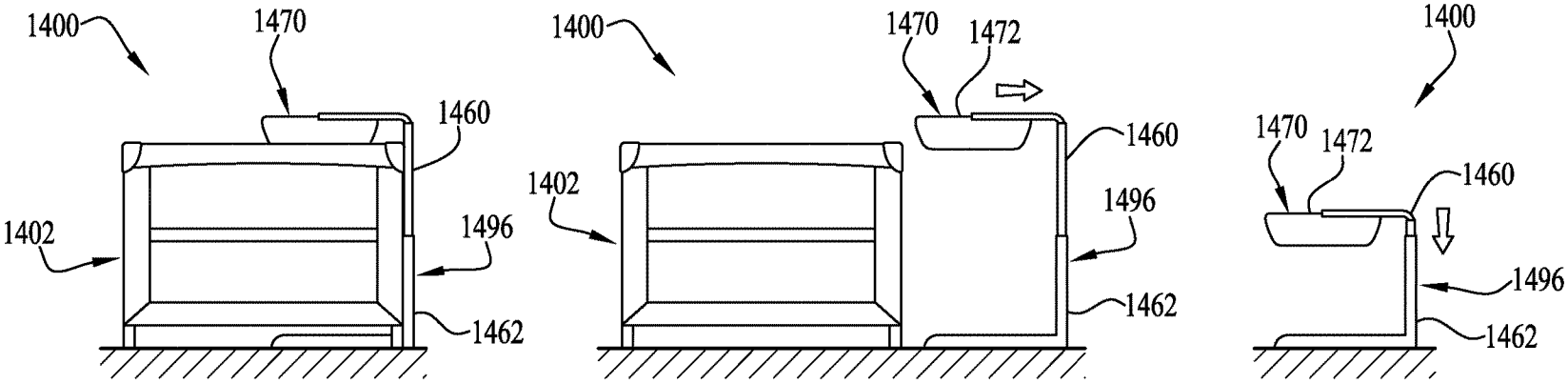
FIG. 20A
FIG. 20B
FIG. 20C

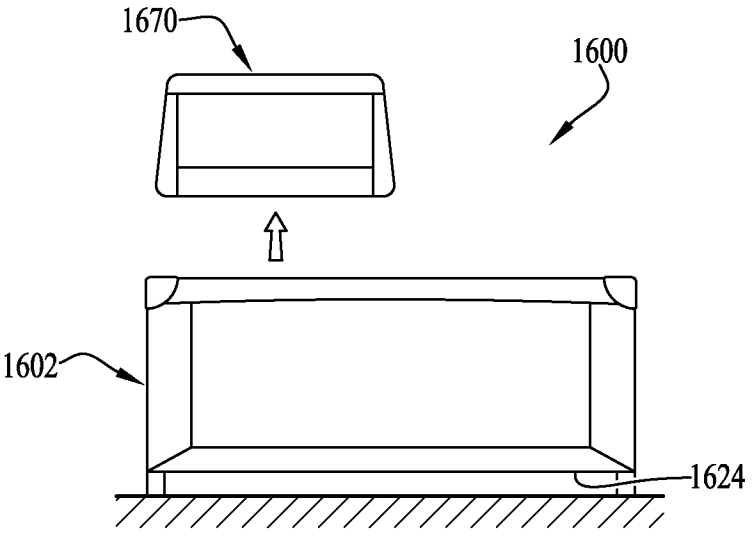
FIG. 22A
FIG. 22B
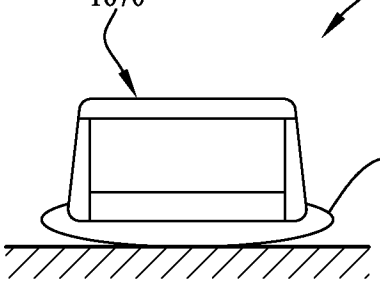
FIG. 22C
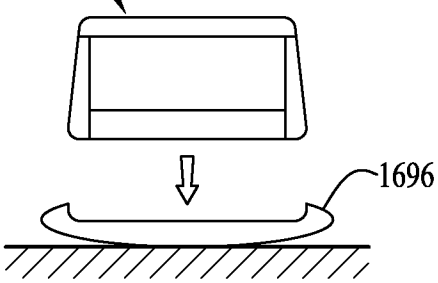
FIG. 22D
FIG. 22E

CHILD SUPPORT DEVICE

CROSS-REFERENCE TO RELATED APPLICATION

This application is a continuation-in-part of U.S. Non-Provisional patent application Ser. No. 15/082,680 filed Mar. 28, 2016, which claims the priority benefit of U.S. Provisional Patent Application Ser. No. 62/139,994 filed Mar. 30, 2015; this application also claims priority to U.S. Provisional Patent Application Ser. No. 62/287,100 filed Jan. 26, 2016, the entireties of which are hereby incorporated herein by reference for all purposes.

TECHNICAL FIELD

The present invention relates generally to the field of children's accessories and child containment devices, and more particularly to a child support system for a play yard or other child containment device.

BACKGROUND

Child containment devices such as play yards, play pens, cribs, sleepers, and the like are commonly used to provide a safe and comfortable area for infants and small children to play and rest. Such devices commonly include a frame, a horizontal floor and vertical walls. The frame may be a foldable structure for portability and ease of use. Care of infants and small children often also involves use of a changing table for supporting the child during diaper changes or clothes changing. Smaller infants and children also often use an enclosed bassinet or cradle-like structure for sleeping.

In some instances, it may be desirable to provide parents or other adult caregivers with an integrated system including a changing table and/or a bassinet or sleeper in combination with a play yard or other child containment device. Continuing improvements in this field of endeavor are sought. It is to the provision of an improved child support system meeting these and other needs that the present invention is primarily directed.

SUMMARY

The present invention provides an improved child support system, which in example embodiments provides parents or other adult caregivers with an integrated system for positioning and supporting an infant or small child for play, rest and care. In example forms, the system includes a first child support unit such as a changing table, and a second child support unit such as a bassinet or sleeper, configured for use in combination with a play yard or other child containment device. One or both of the first and second child support units are optionally repositionable and/or removable to allow the caregiver to customize the system to a variety of applications and user preferences.

In one aspect, the present invention relates to a child support system. The child support system preferably includes a child containment device defining a containment space bounded by at least one sidewall and a floor. The child support system preferably also includes a first child support unit configured for use in connection with the child containment device mounted to the child containment device in a first position, and a second child support unit configured for use in connection with the child containment device mounted to the child containment device in a second position. The second child support unit is preferably supported at a first subframe component by the first child support unit, and supported at a second subframe component by the child containment device.

In another aspect, the present invention relates to a child support system, the child support system preferably including a children's play yard having four corner posts, sidewalls extending between the corner posts, and a floor, the sidewalls and floor defining a generally rectangular containment space within the play yard. The child support system preferably also includes a first child support unit having a first support sub-frame and frame attachment members extending from a first subframe component of the first support sub-frame. The frame attachment members are preferably configured for attachment to the corner posts of the play yard. The first child support unit preferably also includes at least one first detachable coupling element along a second subframe component of the first support sub-frame generally opposite the first subframe component. The child support system preferably also includes a second child support unit having a second support sub-frame, at least one second detachable coupling element along a first subframe component of the second support sub-frame, and at least one support member at a second subframe component of the second support sub-frame. The first and second detachable coupling elements preferably releasably engage one another to support the first subframe component of the second support sub-frame of the second child support unit, and the at least one support member preferably engages the children's play yard to support the second subframe component of the second support sub-frame of the second child support unit.

In another aspect, the present invention relates to a method of supporting a child in at least first and second positions relative to a children's play yard. The method preferably includes mounting a first child support unit to the play yard by attaching a first subframe component of the first child support unit to the play yard, and mounting a second child support unit to the play yard by attaching a first subframe component of the second child support unit to the first child support unit and by supporting a second subframe component of the second child support unit upon the play yard.

In another aspect, the present invention relates to a child support system. The child support system preferably includes a child containment device defining a containment space bounded by at least one sidewall and a floor. The child support system preferably also includes at least one child support unit configured for a first mode of use in connection with the child containment device, and configured for a second mode of use independent of the child containment device. Optionally, the child support unit can rest on a support surface or be attached to a support stand when used independent of the child containment device.

In another aspect, the present invention relates to a child support system, the child support system preferably including a children's play yard having four corner posts, sidewalls extending between the corner posts, and a floor, the sidewalls and floor defining a generally rectangular containment space within the play yard. The child support system preferably also includes a first child support unit having a first support sub-frame, and being configured for use in combination with the play yard. The child support system preferably also includes a second child support unit having a second support sub-frame, and being configured for use in combination with the play yard. At least one of the first child support unit and the second child support unit is/are configured for an alternative mode of use independent of the play yard.

In another aspect, the present invention relates to a method of supporting a child in at least first and second positions relative to a children's play yard. The method preferably includes mounting a child support unit to the play yard by attaching a first subframe component of the first child support unit to the play yard, and selectively detaching the child support unit from the play yard for use independent of the play yard.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary and explanatory of example embodiments of the invention, and are not restrictive of the invention, as claimed.

BRIEF DESCRIPTION OF THE DRAWINGS

FIGS. 17A-D show side views of a child support system with a child containment device, child support unit and a support stand according to another example embodiment of the invention.

FIGS. 18A-C show side views of a child support system with a child containment device, child support unit and a support stand according to another example embodiment of the invention.

FIGS. 19A-D show side views of a child support system with a child containment device, child support unit and a support stand according to another example embodiment of the invention.

FIGS. 20A-C show side views of a child support system with a child containment device, child support unit and a support stand according to another example embodiment of the invention.

FIGS. 22A-E show side views of a child support system with a child containment device, child support unit and a support stand according to another example embodiment of the invention.

DETAILED DESCRIPTION OF EXAMPLE EMBODIMENTS

Figure 1:
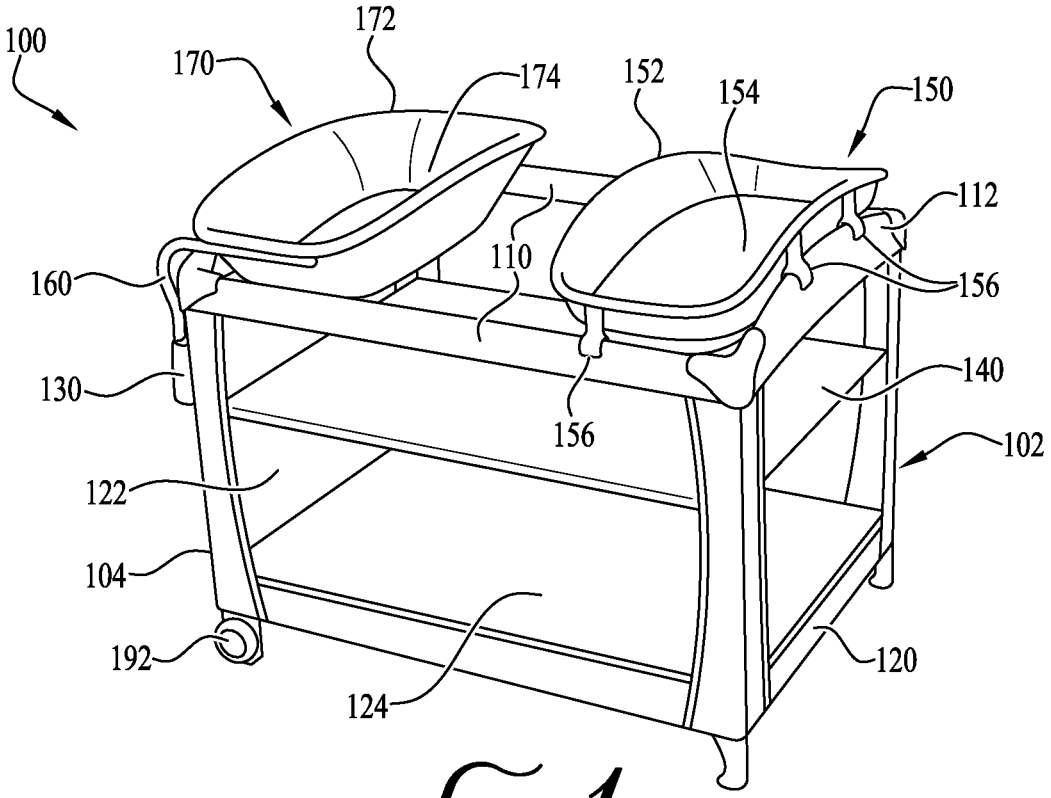
FIG. 1 is a perspective view of a child support system with a child containment device and child support units according to an example embodiment of the invention.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-13 show example embodiments of child support systems for a play yard or other child containment device, the system including a child a first child support unit and, optionally, a second child support unit. The child containment device is depicted as a play yard, but in alternate embodiments may take the form of a crib, playpen, sleeper, or other form of child containment or resting device. In example embodiments, the first child support unit comprises a changing table for supporting the child during diaper changing or clothes changing. In example embodiments, the second child support unit comprises a bassinet or cradle-like enclosure for receiving an infant or small child. One or both of the child support units are preferably detachably coupled to the frame of the child containment device.

Figure 2:
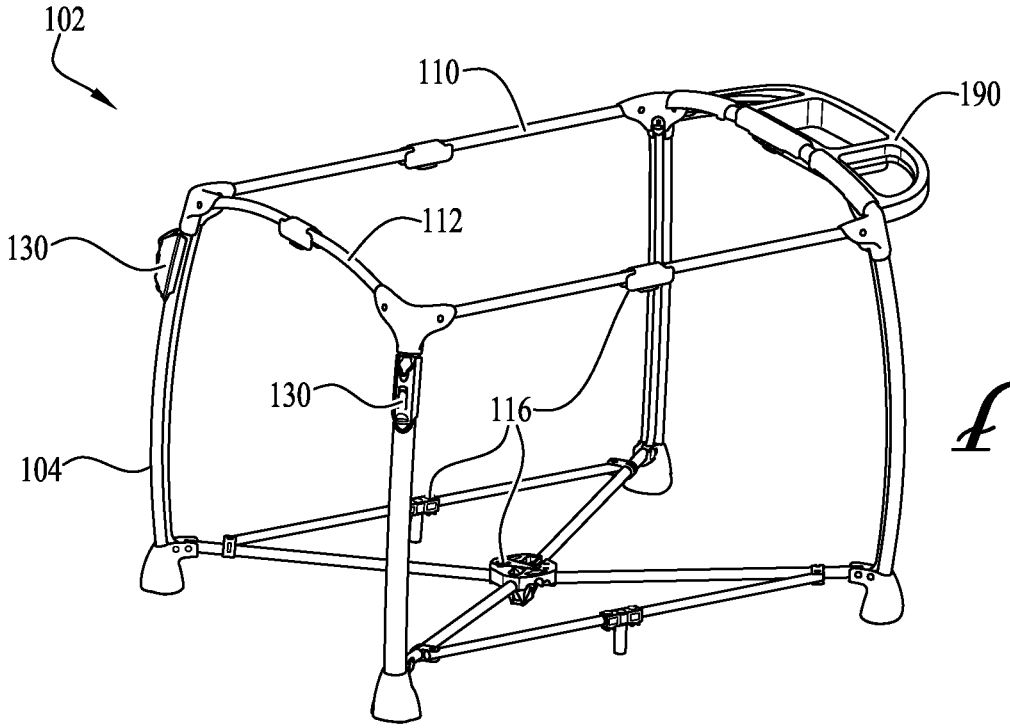
FIG. 2 shows a frame of a child containment device according to an example embodiment, with the wall panels, floor and child support units removed.

FIG. 1 shows a child support system 100 according to an example embodiment of the invention. The system 100 includes a child containment device comprising a foldable frame 102 with a liner 120, a first child support unit 150 and a second child support unit 170. FIG. 2 shows a foldable or collapsible support frame structure 102 for a play yard system according to an example form, with the wall panels, floor and support devices removed. The foldable frame 102 comprises four generally upright corner posts 104, first and second upper side cross-members 110, and first and second upper end cross-members 112, forming a generally rectangular three-dimensional housing bounding an internal contained volume or space for structurally supporting a liner 120 to receive a child therein. In the depicted embodiment, the side cross-members 110 are longer than the end cross-members 112, defining a containment having a length greater than its width. In alternate embodiments, the length and width are generally equal, or the width is greater than the length. In other embodiments, the child support unit 100 has a circular, triangular, or otherwise shaped upper frame. The frame 102 may be collapsible or foldable for more efficient storage and transport when not expanded and set up for use. For example, in the depicted embodiments, the frame 102 includes a plurality of hinges or joints 116 that allow the frame 102 to be folded into a collapsed configuration. U.S. patent application Ser. No. 15/047,912 is incorporated by reference as showing an example of a collapsible frame 102 for a child containment device. In alternate embodiments, the frame can be a substantially rigid frame that is not foldable or collapsible.

The liner 120 of the child containment device comprises one or more side walls, for example a plurality of side walls 122 and a floor panel 124 which define an enclosure for receiving a child. In the example embodiment, the frame 102 includes mounting sleeves 130 which are attached to upper portions of the corner posts 104. The child containment device may optionally also include a raised bassinet mattress or raised floor panel 140 spaced a distance above the main floor panel 124, for use with an infant or smaller child who is not yet standing. Some example embodiments include a removable, zip-in bassinet. In example embodiments, one or more fasteners positioned around the perimeter of the mattress or bassinet. The fastener is configured to removably mate with a corresponding mating fastener located on the play yard or child containment device, for example on the liner 120. The fasteners can comprise interengagable rows of zipper teeth that are fastened by zipping them together about the perimeter of the bassinet or mattress. Alternative fasteners such as snaps, clips, buttons, hook-and-loop materials, and/or the like may be utilized instead of or in addition to the zipper. U.S. patent application Ser. No. 14/021,934 is incorporated by reference as showing an example of a child containment device with a raised bassinet mattress or floor panel 140. Optionally, one or more accessory trays or bins 190 are mounted to the frame 102 for holding toys, diaper supplies, a pacifier, or other items. Optionally, the frame 102 comprises one or more wheels 192 to aid in transporting the child support system 100.

As depicted in FIG. 1, the first child support unit 150 includes a generally rectangular subframe 152 with one or more subframe components such as side and/or end subframe components, and a generally planar support panel 154 mounted onto the subframe to form a platform for supporting a child placed in or on the first child support unit 150, for example for use as a changing table or changing station for changing diapers or dressing the child. In example embodiments, the subframe 152 comprises two side subframe components, forming the length of the subframe, coupled to end sub-frame components, forming the width of the subframe, defining a generally rectangular subframe. In alternate embodiments, different subframe component arrangements and subframe shapes are provided. The second child support unit 170 includes a subframe 172 with one or more subframe components comprising a generally rectangular periphery and soft-goods 174, such as fabric and padding, installed onto the subframe 172 to form a sling, bassinet, bed or cradle for supporting a child placed in or on the second child support unit 170, for example to support and contain the child when sleeping or resting. In example embodiments, the subframe 172 comprises two side components, forming the length of the subframe, and coupled to end components, forming the width of the subframe. In example embodiments, the first child support unit 150 is supported through engagement with one or more side cross-members 110 and/or an end cross-member 112 of the frame 102, and the second child support unit 170 is supported through engagement with one or more upright corner posts 104 of the frame 102. Alternatively, the first child support unit 150 can be supported through engagement with one or more of the upright corner posts 104, and the second child support unit 170 can be supported through engagement with one or more side cross-members 110 and/or end cross-member 112. In yet another embodiment, both the first and second child support units 150, 170 can be supported through engagement with one or more of the upright corner post 104, and in still another embodiment, both the first and second child support units can be supported through engagement with one or more side cross-members 110 and/or an end cross-member 112.

The first child support unit 150 is removably attached to the frame by one or more couplings 156. In the example embodiment, the couplings 156 are support struts with engagement clips or collars for releasable engagement with support tubes or other portions of the support frame 102 of the child containment device. In example embodiments, the first child support unit 150 is configured such that its length is parallel with the end cross-members 112 of the frame 102. In example embodiments, the first end of the each support strut 156 is attached to a component of the sub-frame 152, such as a side or end sub-frame component, and the free end of the support strut contains an engagement clip. The engagement clip end of the coupling 156 is snapped onto the child containment device frame 102. In the depicted embodiment, two couplings 156 are attached to a side components of the sub-frame 152 and engage with an end cross-member 112 of the frame 102, and one coupling 156 is attached to each end of the subframe 152 and engages with the respective side cross-member 110 of the frame 102. In alternate embodiments, various alternative coupling elements may be utilized for permanently or detachably mounting the first child support unit 150 to the frame 102. For example, the couplings 156 can comprise engagement clips at both ends of the support struts and can be detachably coupled with both the child containment device frame 102 and the first child support unit subframe 152. Other embodiments comprise alternative arrangements of couplings 156.

The system 100 optionally further comprises a second child support unit 170. In the depicted embodiment, the second child support unit 170 is mounted to the frame 102 with two sleeve mounts 130 and L-shaped mounting bars 160, as shown in FIG. 1. The second child support unit 170 is configured such that its length is parallel with the end cross-members 112 of the frame 102. The first end of each mounting bar 160 attaches to the second child support unit subframe 172 with a ferrule coupling. The second end of the mounting bars 160 attach to the sleeve mounts 130 on the upright corner posts 104 of the frame 102. The sleeve mounts 130 are located on the upright corner posts 104 on the opposite side of the frame 102 from the end cross-member 112 supporting the first child support unit 150. The sleeve mounts 130 comprise a cylindrical channel or receiver that is open at the top, closed at the bottom and has a diameter that will accommodate the mounting bar 160. The second end of each mounting bar 160 is coupled with a sleeve mount 130 by inserting the end of the bar 160 into the open top of the sleeve mount 130. In alternative embodiments, the sleeve mount 130 includes a releasable engagement feature designed to keep the mounting bar 160 engaged with the sleeve mount 130 until the engagement feature is released. Optionally, the mounting bars 160 are rotationally engaged with the sleeve mount 130 to facilitate compact storage when removed from the frame 102. In alternative embodiments, the mounting bar 160 is releasably attached to the subframe 172, for example with engagement clips.

Figure 3:
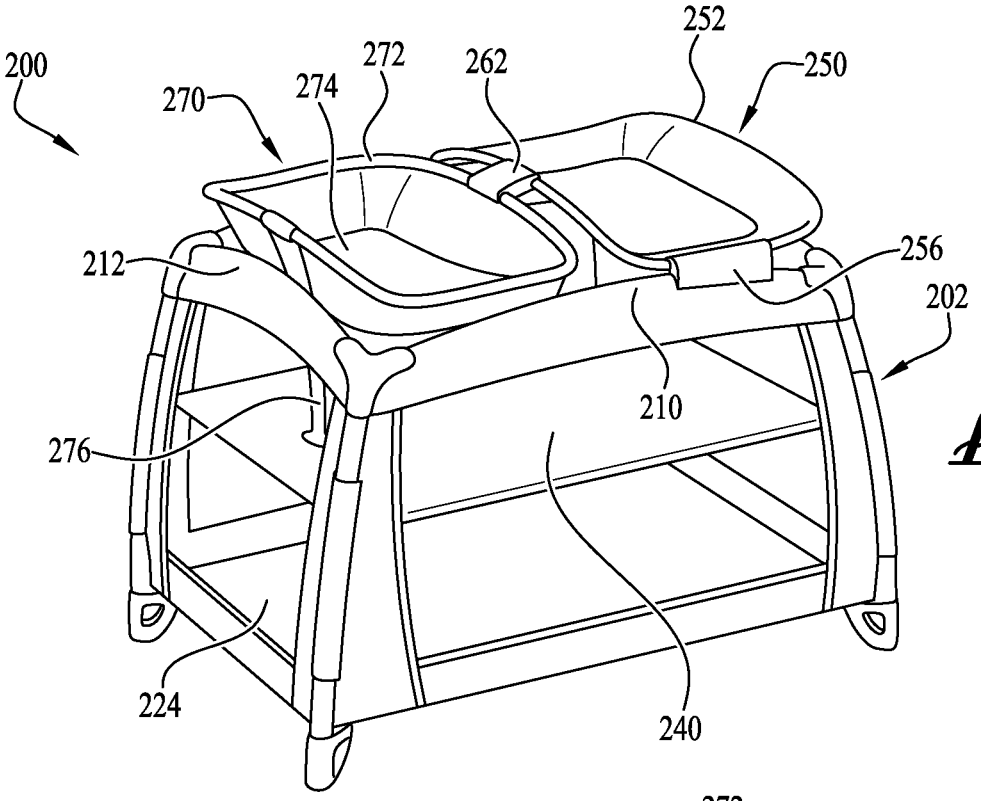
FIG. 3 is a perspective view of a child support system according to another example embodiment of the invention.
Figure 4:
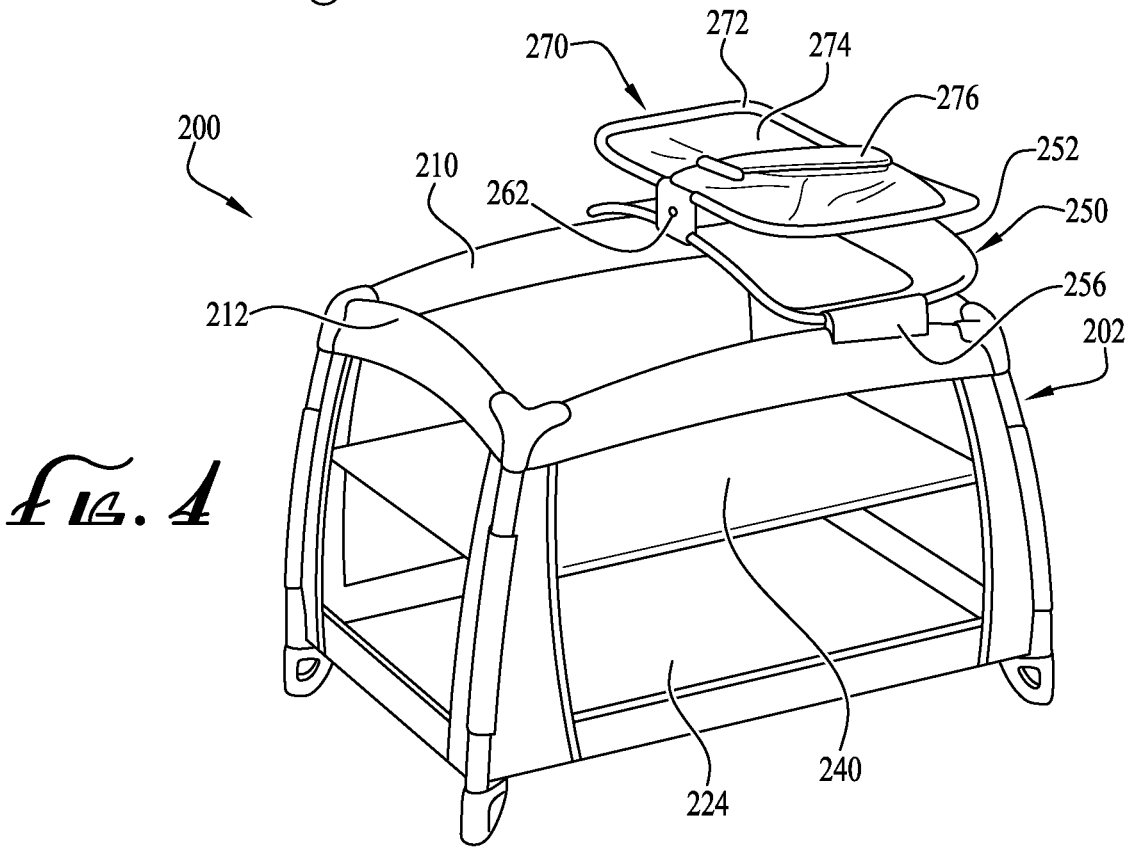
FIG. 4 shows an alternate configuration of the child support system of FIG. 3.

FIGS. 3 and 4 show a child support system 200 according to another example embodiment of the invention. In this embodiment the first child support unit 250 is supported through engagement with one or more side cross-members 210 and/or an end cross-member 212 of the frame 202. The second child support unit 270 is supported on one side by a pivotal coupling with the first child support unit 250 and on the other side by a support member 276 which extends downwardly to engage the raised bassinet mattress 240. In this embodiment, the first child support unit 250 and second child support unit 270 are engaged with a pivotal coupling 262 which allows the second child support unit 270 to be moved between an in-use position (FIG. 3) and a storage position (FIG. 4).

As depicted in FIG. 3, the first child support unit 250 is removably engaged with the side cross-members 210 of the frame 202 through couplings 256 attached to the end components of the first child support unit subframe 252. The first child support unit 250 is configured such that its length is parallel with the end cross-members 212 of the frame 202. The couplings 256 at the ends of the subframe 252 releasably engage with the respective side cross-members 210 of the child containment device frame 202. Alternate embodiments comprise alternative arrangements of couplings.

The second child support unit 270 is coupled to the first child support unit 250 with a pivotal support coupling 262. The second child support unit 270 is configured such that its length is parallel to the length of the first child support unit 250. The second child support unit 270 is positioned adjacent to the first child support unit 250. The pivotal coupling 262 is attached to the first child support unit subframe 252 and the second child support unit subframe 272. The pivotal coupling 262 has a range of motion such that the second child support unit 270 can be rotated from its in-use position, depicted in FIG. 3, to its storage position, depicted in FIG. 4. When in-use, the second child support unit 270 is positioned next to the first child support unit 250 and is horizontal, with the subframe 272 parallel with the child containment device floor 224 and the opening of the second child support unit 270 facing upwards. In the storage position, the second child support unit 270 is also in a horizontal position with the subframe 272 parallel with the child containment device floor 224, but with the opening facing downward. In the depicted embodiment, the second child support unit 270 in the storage position is positioned directly above and resting on the first child support unit 250, moving the second child support unit out of the way to permit access to and from the main containment area of the play yard. In alternative embodiments, the second child support unit 270 is pivoted below the first child support unit 250 in the storage position. In other embodiments, the pivotal coupling 262 includes a lock or catch to prevent the second child support unit 270 from pivoting beyond the in-use position or storage position. Optionally, the pivotal coupling 262 includes a releasable locking mechanism that holds the second child support unit 270 in the in-use or storage position until the releasable lock is disengaged. Further, the sling portion 274 of the second child support unit 270 can be folded when the second child support unit 270 is in the storage position, giving it a substantially flat profile.

Example embodiments also include a support member 276, one end of which attaches to a side subframe component of the second child support unit 270, and the other end of which engages with the bassinet mattress 240 to support the second child support unit 270 in its use position, as depicted in FIG. 3. In the depicted embodiment, the support member 276 comprises a single support leg. The support member 276 is hingedly attached to the second child support unit subframe 272 on the opposite side from the pivotal coupling 262. When in use, the support leg 276 is in a generally vertical position so that it engages with the bassinet mattress 240 and supports the second child support unit 270 in the in-use position. As depicted in FIG. 4, the attachment of the support leg 276 to the sub-frame 272 is hinged or pivotal so that the support leg 276 can be folded into a horizontal or flat position when the second child support unit 270 is pivoted to the storage position.

Figure 5:
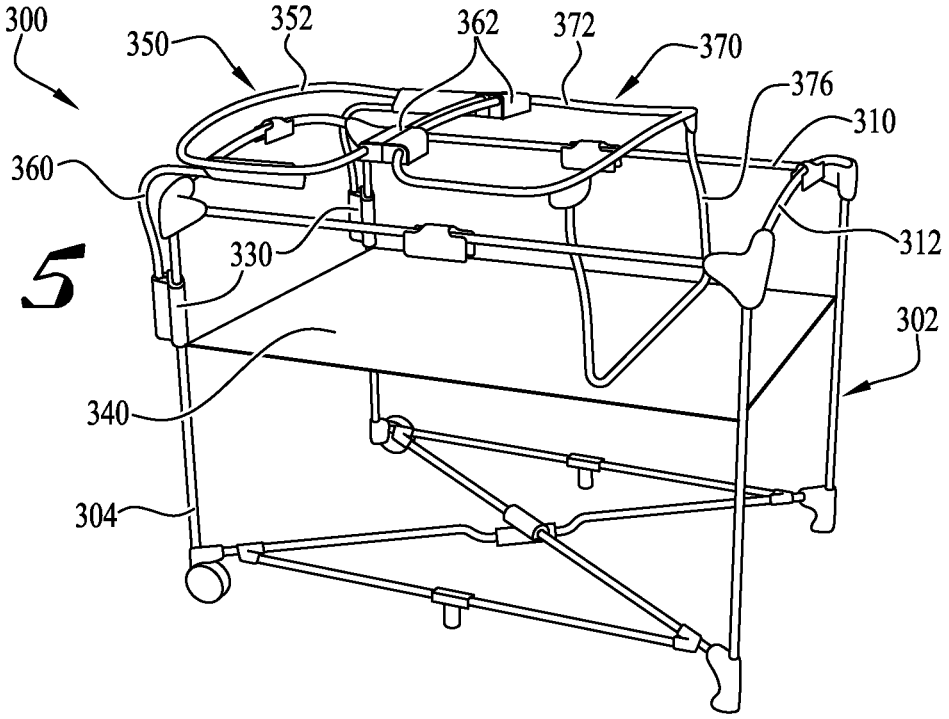
FIG. 5 is a perspective view of a child support system with a child containment device and child support units according to another example embodiment of the invention.
Figure 6:
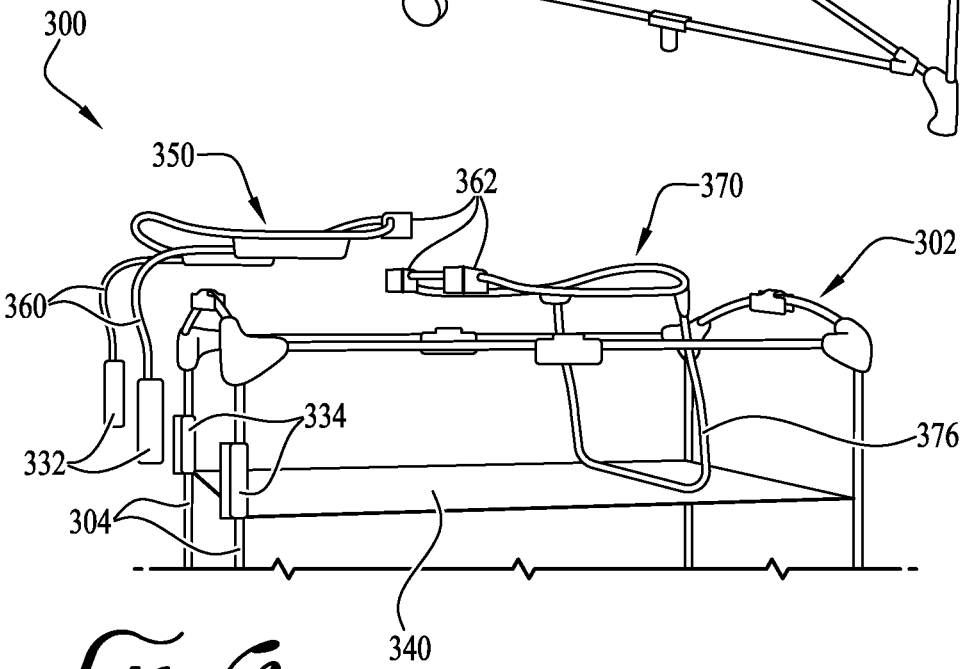
FIG. 6 is an exploded assembly view of the child support system of FIG. 5.
Figure 7:
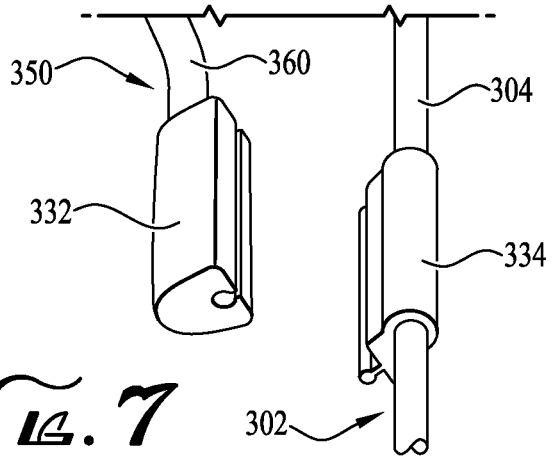
FIG. 7 is a detailed view of a coupling between the child containment device and a child support unit of FIG. 5, according to another example embodiment of the invention.

FIGS. 5-7 show a child support system 300 for a play yard or other child containment apparatus, according to another example embodiment of the invention. In this embodiment, the first child support unit 350 is supported through engagement with one or more channel mounts 330 on the upright corner posts 304 of a play yard frame 302. The second child support unit 370 is supported through engagement with the first child support unit 350 and a support member 376 which engages with the raised bassinet mattress 340 or other portion of the play yard. The first support unit 350, for example, comprises a generally rectangular support subframe 352 having first and second side support sub-frame components and first and second end support sub-frame components. A fabric or soft-goods covering is attached to the support frame of the first child support unit 350, for example to provide a changing table or other support surface for positioning an infant or small child upon. The second child support unit 370 also comprises a generally rectangular support sub-frame 372 having first and second side support sub-frame components and first and second end support sub-frame components. A fabric or soft-goods covering is attached to the support frame of the second child support unit 370, for example in the form of a sling or hammock, or a four-sided bed receiver to provide a bassinet, sleeper unit or other smaller containment or resting space for an infant or small child.

As depicted in FIG. 5, the first and second child support units 350, 370 attach with one another in a first or deployed configuration, wherein the first and second child support units are connected and alongside one another over the contained space of the play yard. When attached and in the deployed configuration, the first and second child support units 350, 370 are coupled to one another along their confronting or inboard sides, and are separately supported by the play yard at their opposite or outboard sides. For example, in the depicted embodiment, the first child support unit 350 is supported at its outboard side on corner posts of the play yard frame, and the second child support unit 370 is supported at its outboard side by the upper bassinet mattress or panel 340 of the play yard. In example embodiments, the first child support unit 350 is generally self-supporting (i.e., does not require support from the second child support unit) when mounted to the play yard, whereas the second child support unit 370 is supported on one side by its attachment to the first child support unit. In this manner, the first child support unit 350 can be used with or without the second child support unit 370, but the second child support unit is not configured for use apart from the first child support unit. In this manner, a caregiver cannot use the second child support unit 370 independent of the play yard on a potentially unsafe support surface. In alternate embodiments, either or both of the first and second child support units can be configured for use independently and separate from the other, or alternatively relying on one another for support.

In example embodiments, as depicted in FIG. 5, the first child support unit 350 is mounted to the frame 302 of the play yard with two channel mounts 330 and L-shaped mounting bars 360. The first child support unit 350 is configured such that its length is parallel with the end cross-members 312 of the frame 302 when mounted to the play yard. The first end of each mounting bar 360 attaches to the first child support unit subframe 352. The second end of each mounting bar 360 includes a female channel coupling portion 332 of the channel mount 330. A corresponding male rib portion 334 of the channel mount 330 is attached to each of two upright corner posts 304 on either side of the width of the play yard frame 302. Each mounting bar 360 is engaged with the corresponding corner post 304 by engaging the female portion 332 and male portion 334 of the channel mount 330, as shown in FIG. 7. In alternate embodiments, the second end of the mounting bar 360 comprises a male rib and the upright corner posts 304 comprise the female channel portion of the channel mount 330, or other coupling formats can be utilized.

The second child support unit 370 is attached for support on one side (its inboard side) to the first child support unit 350 with one or more detachable couplings, and in the depicted embodiment by two dove-tail joint detachable couplings 362 positioned at confronting spaced locations on adjacent inboard sides of the first and second child support units. The second child support unit 370 is configured such that its length is generally parallel to the end cross-members 312 of the frame 302, and generally parallel with the first child support unit 350, when deployed for use. As depicted in FIG. 6, the couplings 362 comprise a first coupling element attached to the side sub-frame component of the first child support unit subframe 352 and a cooperatively engaging second coupling element attached on an adjacent corresponding position of the side sub-frame component of the second child support unit subframe 372. Alternatively, the couplings can be configured to support between end, side or other sub-frame components of the first and or second child support units. The couplings 362 are attached to the first child support unit subframe 352 on the side opposite from which the corner post mounting bars 360 extend. In example embodiments the couplings 362 comprise slidingly engaging dovetail joint couplings, snaps, channel and rib couplings, clips, hooks, magnetic couplings or other detachable coupling members, which allow the second child support unit 370 to be securely connected to the first child support unit 350 when deployed for use in connection with the play yard, and to be easily detached and removed from the first child support unit when not in use to allow access to the play yard.

When deployed for use, the second child support unit 370 is also supported on its other side (its outboard side) by an upright support member 376. In the depicted embodiment, the support member 376 is a U-shaped bar with its ends attached to the second child support unit sub-frame 372 on the side opposite from which the corner-post coupling bars 360 extend. When the second child support unit 370 is deployed for use in the play yard, the cross bar of the U-shaped support member 376 extends downwardly, generally perpendicular to the second child support unit sub-frame 372, into contact with the bassinet mattress 340 or other portion of the play yard to support the second child support unit 370 in a substantially horizontal position over the play yard. The support member 376 of the second child support unit 370 is optionally pivotally or hingedly mounted to the second child support unit sub-frame 372, so that it can be folded flat with the sub-frame for compact storage or transport when detached from the play yard and not in use. In example embodiments, the first child support unit 350 is a changing table or other child support element intended for longer term use in connection with the play yard, and thus configured for use independent of the second child support unit 370; whereas the second child support unit is a sleeper or small bassinet, intended for shorter term use so that it can be removed from connection with the play yard when a child outgrows the second child support unit, to allow easier access to the main containment area of the play yard.

Figure 8:
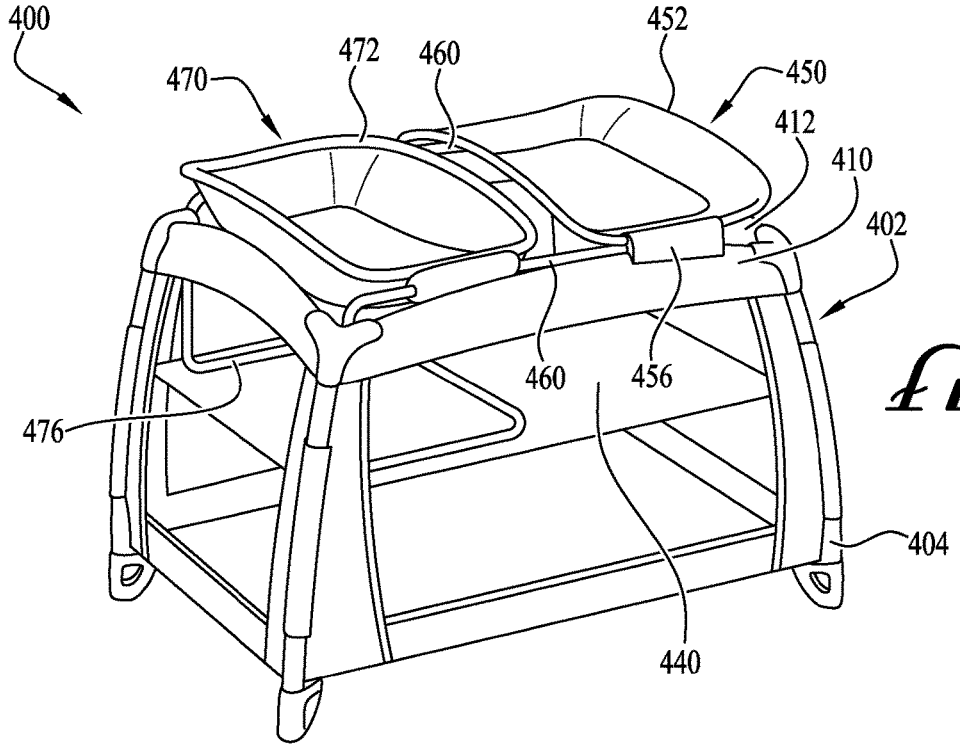
FIG. 8 is a perspective view of a child support system according to another example embodiment of the invention.
Figure 9:
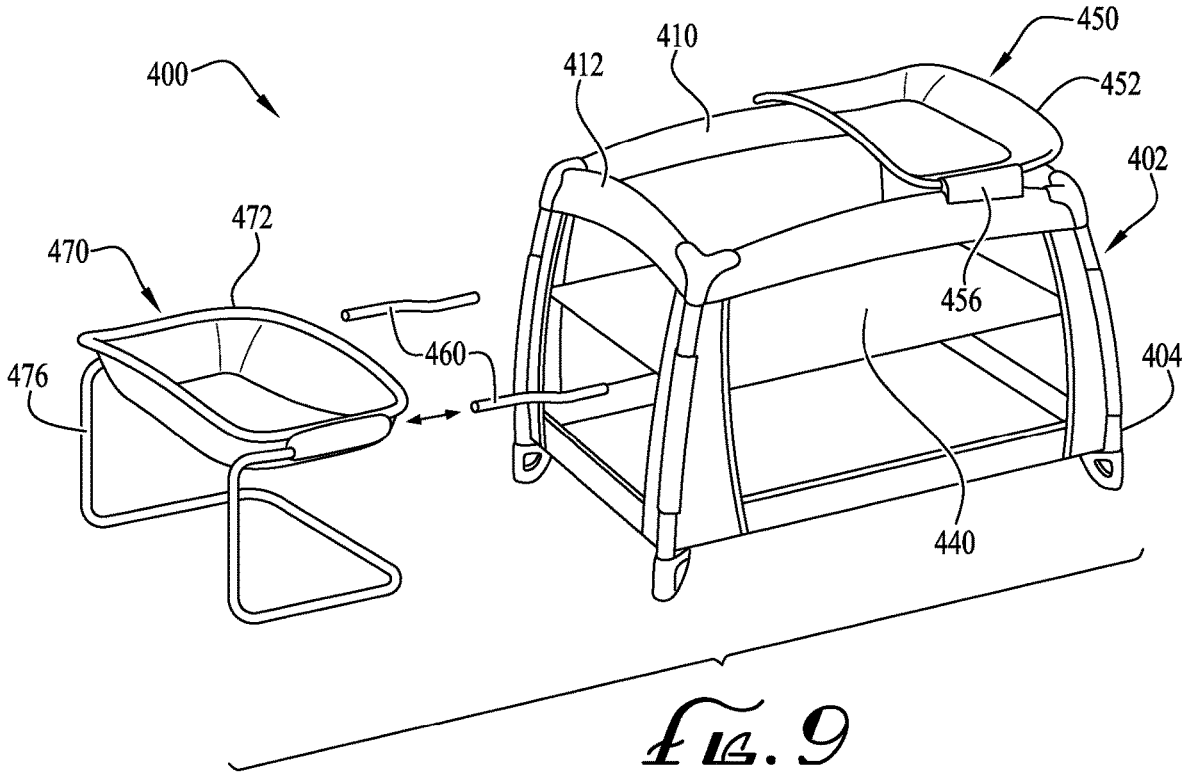
FIG. 9 shows an exploded assembly view of the child support system of FIG. 8.

FIGS. 8 and 9 show a child support system 400 according to another example embodiment of the invention. In this embodiment, the first child support unit 450 is supported through engagement with one or more side cross-members 410 and/or an end cross-member 412 of the play yard frame 402. The second child support unit 470 is supported through engagement with the first child support unit 450 and a support member 476 which engages with the raised bassinet mattress 440.

As depicted in FIG. 8, the first child support unit 450 is removably engaged with the side cross-members 410 of the frame 402 through couplings 456 attached to each end sub-frame component of the first child support unit subframe 452. The first child support unit 450 is configured such that its length is parallel with the end cross-members 412 of the frame 402. The couplings 456 at the ends of the subframe 452 releasably engage with the respective side cross-member 412 of the child containment device frame 402. Alternate embodiments comprise alternative arrangements of couplings.

The second child support unit 470 is releasably mounted to the first child support unit 450 using two mounting bars 460. The second child support unit 470 is arranged so that its length is parallel to the end cross-members 412 of the frame 402 and it is positioned adjacent to the first child support unit 450. The first end of each mounting bar 460 is releasably attached to the first child support unit subframe 452 such that the mounting bars 460 are parallel with the side cross-members 410 of the frame 402. The second end of each mounting bar 460 is releasably engaged with the subframe 472 of the second child support unit 470. The mounting bars 460 attach at the ends of the sub-frames 452, 472. In alternate embodiments the mounting bars 460 are permanently attached to either the first child support unit 450 or second child support unit 470 and releasably attached to the other. The second child support unit 470 is also supported by a support member or stand 476. The support member 476, shown in FIG. 9, has two L-shaped bars and a U-shaped base. The ends of the L-shaped bars attach to the second child support unit subframe 472. The base of the support stand 476 rests on the raised bassinet mattress 440 and supports the second child support unit 470 in a substantially horizontal position. The support member 460 is configured so that when the second child support unit 470 is detached from the first child support unit 450, it can be used independently of the child support system 400 supported only by the support stand 476.

Figure 10:
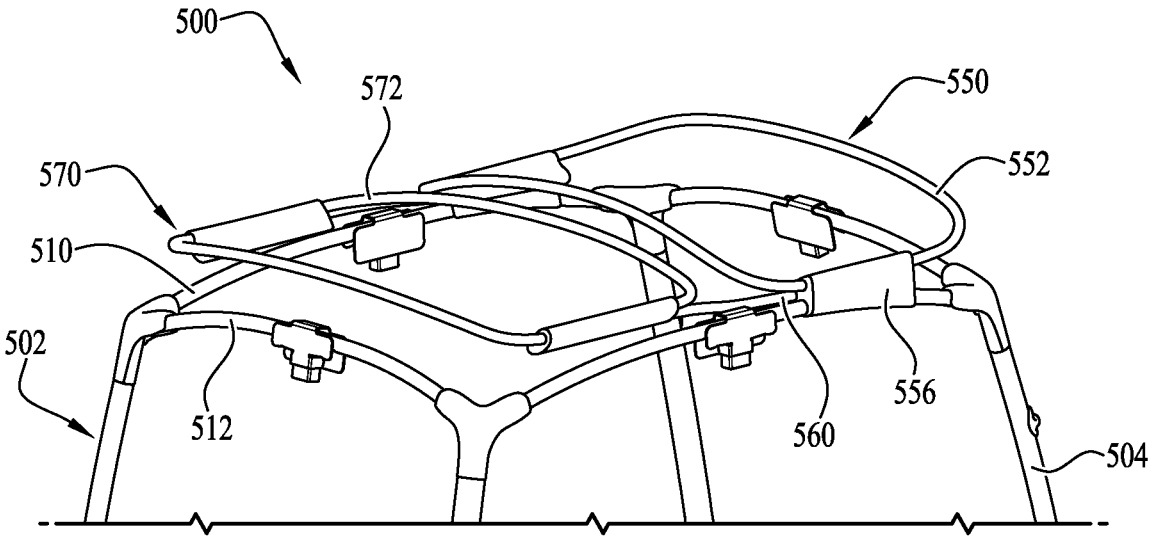
FIG. 10 is a perspective view of a child support system according to another example embodiment of the present invention.

FIG. 10 shows a child support system 500 according to another example embodiment of the invention. In this embodiment, the first child support unit 550 is supported through engagement with one or more side cross-members 510 and/or an end cross-member 512 of the frame 502. The second child support unit 570 is supported through engagement with the first child support unit 550 through mounting bars 560.

The first child support unit 550 is removably attached to the side cross-members 510 of the frame 502 with detachable couplings 556. The first child support unit 550 is configured such that its width is parallel with the side cross-member 510 of the frame. Each coupling 556 comprises two engagement clips. The first engagement clip is snapped onto the end sub-frame component of the first child support unit subframe 552 and the second engagement clip is snapped onto the side cross-member 510 of the frame 502. The couplings 556 have a trapezoidal shape so that the subframe 552 is held in a horizontal position despite a curve in the side cross-member 510.

The second child support unit 570 is releasably mounted to the first child support unit 550 using two mounting bars 560. The second child support unit 570 is arranged so that its length is parallel to the end cross-members 512 of the frame 502 and it is aligned with the first child support unit 550. The first end of each mounting bar 560 is releasable attached to one of the couplings 560 which attach the first child support unit 550 to the frame 502. The second end of each mounting bar 560 is demountably attached to the second child support unit subframe 572 of. In alternative embodiments the mounting bars 560 are permanently attached to the second child support unit subframe 572.

Figure 11:
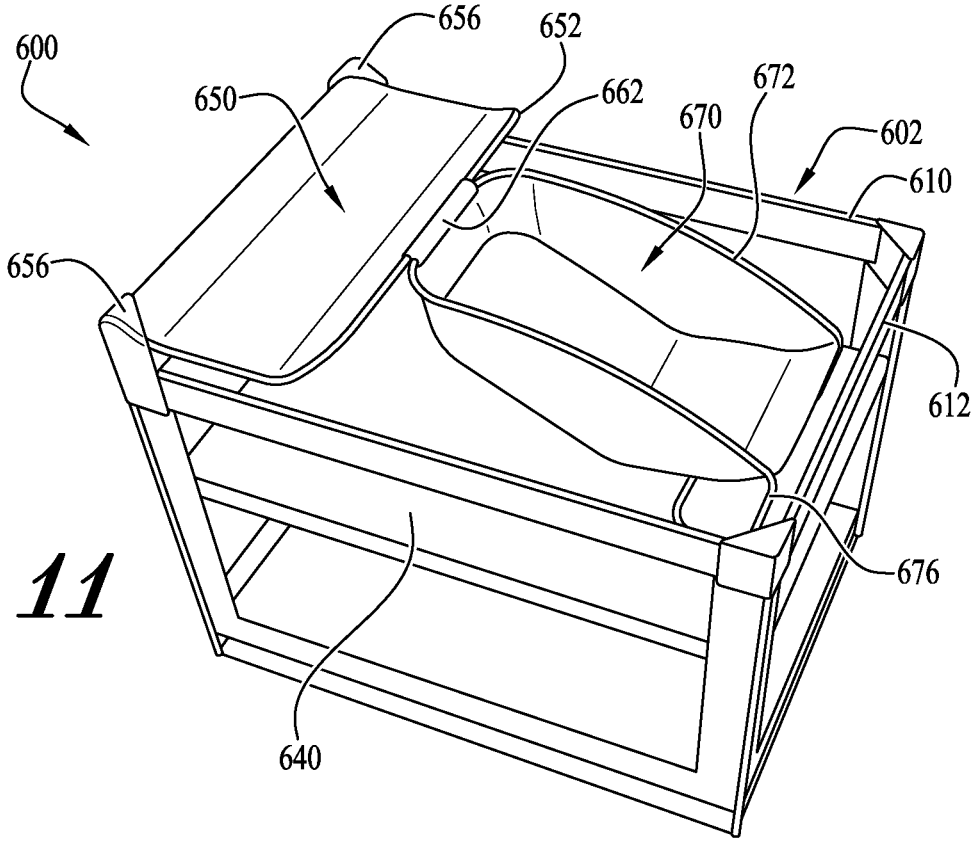
FIG. 11 is a perspective view of a child support system according to another example embodiment of the invention.

FIG. 11 shows a child support system 600 according to another example embodiment of the invention. In this embodiment, the first child support unit 650 is supported through engagement the child containment device frame 602. The second child support unit 670 is supported through engagement with the first child support unit 650 and a support member 676 which engages with the raised bassinet mattress 640. The second child support unit 670 is positioned perpendicular to the first child support unit 650.

In this example embodiment, the first child support unit 650 is removably engaged with the upright corner posts 604 of the child containment device frame 602 via corner couplings 656. The first child support unit 650 is configured such that its length is parallel with the end cross-members 612 of the frame 602. The corner couplings 656 are attached to the top of two upright corner posts 612 on opposite ends of a width of the frame 602. The corner couplings 602 releasably engage with the corners of the first child support unit subframe 652.

The second child support unit 670 is releasably coupled to the first child support unit 650. The second child support unit 670 is configured so that its length is perpendicular with the end cross-members 612 of the frame 602 and the length of the first child support unit subframe 652. The second child support unit 670 is positioned so an end sub-frame component of its subframe 672 is adjacent to the side sub-frame component of the first child support unit subframe 652 opposite the corner couplings 656. An attachment 662 couples that side sub-frame component of the first child support unit subframe 652 to the adjacent end sub-frame component of the second child support unit subframe 672. The second child support unit 670 is also supported by a support member 676. The support member 676 has two L-shaped bars with a U-shaped base. The ends of the L-shaped bars attach to the second child support unit subframe 672 on the end opposite the attachment to the first child support unit 650. The base of the support member 676 engages with the raised bassinet mattress 640. The height of the support member 676 is such that the second child support unit 670 is angled, with the end coupled to the first child support unit 650 higher than the end attached to the support member 676. In alternative embodiments, the support member 676 positions the second child support unit 670 is a substantially horizontal position.

Figure 12:
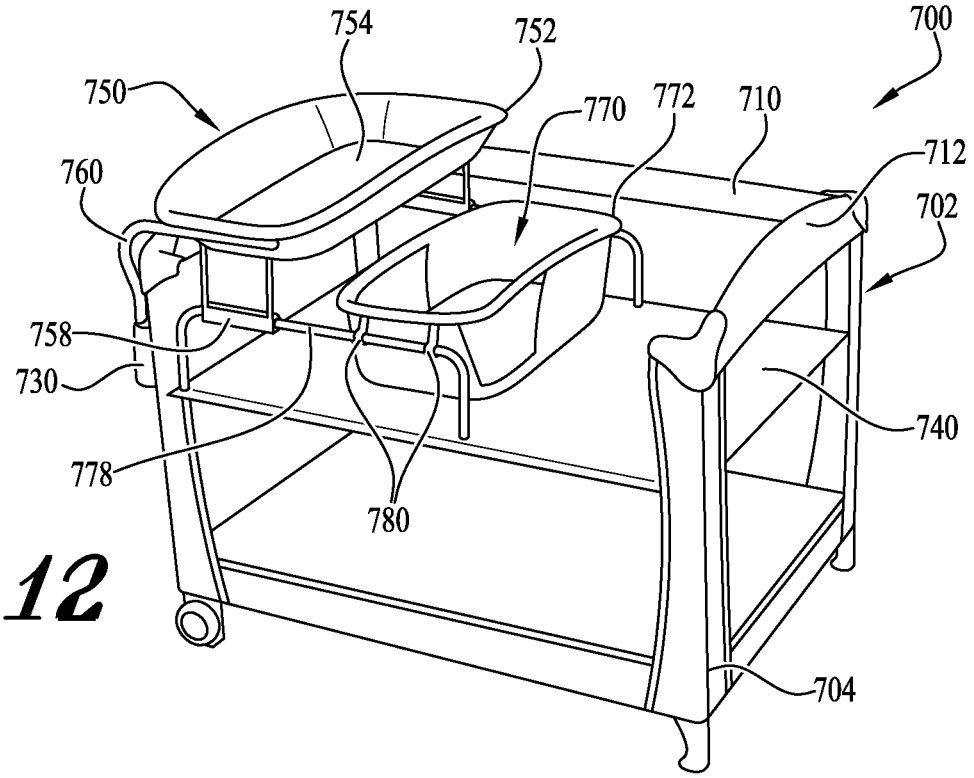
FIG. 12 is a perspective view a child support system according to another example embodiment of the invention.
Figure 13:
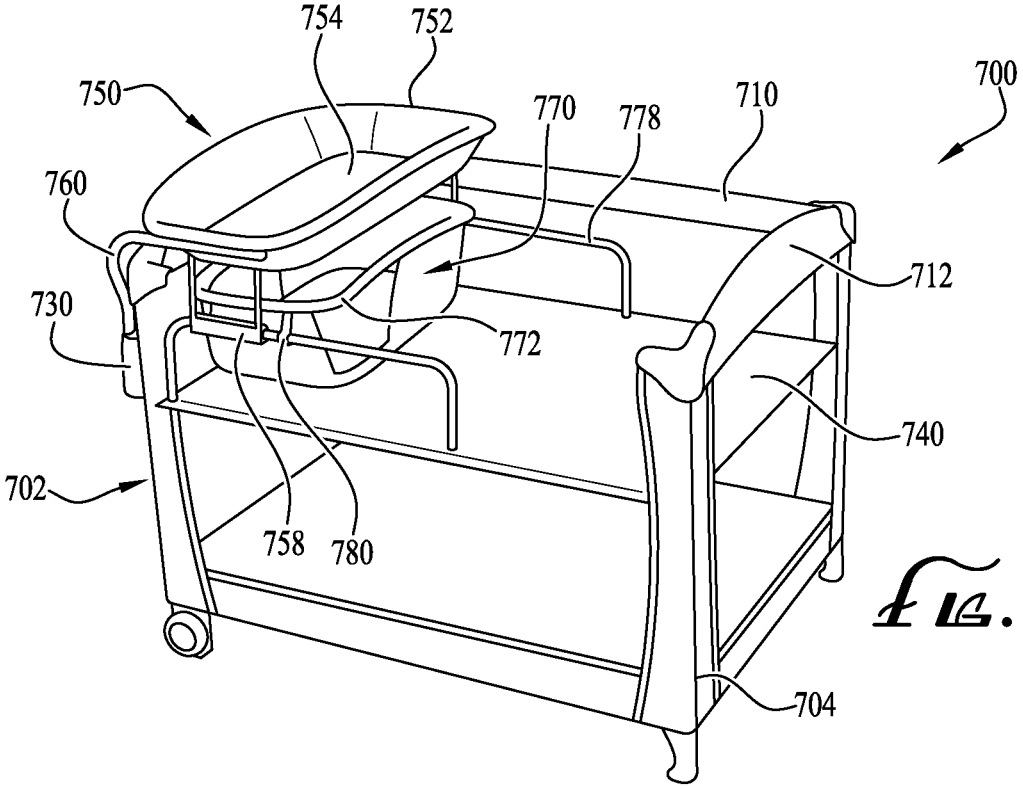
FIG. 13 shows an alternative configuration of the child support system of FIG. 12.

FIGS. 12 and 13 show a child support system 700 according to another example embodiment of the invention. In this embodiment, the first child support unit 750 is supported through engagement with one or more upright corner posts 704 of the frame 702. The second child support unit 770 is slidably coupled to rails 778 which engage with the first child support unit 750 and the raised bassinet mattress 740. The second child support unit 770 slides horizontally on the rails 778, inwardly and outwardly like a drawer, between an extended in-use position and a retracted storage position.

In this embodiment, the first child support unit 750 is mounted to the frame 702 with two mounting attachments 730 and L-shaped mounting bars 760. The first child support unit 750 is configured such that its length is parallel with the end cross-members 712 of the frame 702. The first end of the mounting bars 760 is secured to the first child support unit subframe 752. The second end of the mounting bars 760 engages with the mounting attachments 730 which are each affixed to an upright corner post 704 of the frame 702. Attached to the bottom of the first child support unit's planer support panel 754 are two U-shaped hanging mounts 758 for mounting the sliding rails 778 described below. The ends of the hanging mounts 758 are attached to the widths of the planer support panel 754 at opposite ends so that the cross-bar of each hanging mount 758 is below and parallel to the bottom of the planer support panel 754 and the side cross-members 710 of the frame 702. In alternative embodiments the hanging mounts 758 are attached to the mounting bars 760.

The second child support unit 770 is coupled to the abovementioned sliding rails 778. The sliding rails 778 are U-shaped. The ends engage with the raised bassinet mattress 740 and the cross bars engage with the cross bars of the hanging mount 758. The rails 778 are positioned so that they are parallel with the side cross-members 710 of the frame 702. The hanging mounts 758 are coupled to an end of the rail 778 so that a substantial portion of the rail 778 extends beyond the width of the first child support unit 750. The second child support unit 770 engages with the sliding rails 778 through multiple sliders 780. The sliders 780 are attached to the end sub-frame components of the second child support unit subframe 772 and engage with the cross-bar of the sliding rails 778. The sliders 780 are configured to allow the second child support unit 770 to slide along the rails 778 between an in-use position, depicted in FIG. 12, and a storage position, depicted in FIG. 13. When in-use the second child support unit 770 is positioned at the opposite end of the sliding rails 778 from the hanging mounts 758 so that the second child support unit 770 is adjacent to the first child support unit 750. In the storage position, the second child support unit 770 is positioned under the first child support unit 750. In the described embodiments, the support members and sliding rails are described as engaging the raised bassinet mattress. In alternative embodiments the support members are sufficient length to engage the floor of the child containment device. In other embodiments the support members comprise a telescoping feature so the same support member can engage the floor of the child containment device when expanded and the raised bassinet mattress when collapsed.

FIGS. 14A-D show a child support system 800 according to another example embodiment of the invention. In this embodiment, the first child support unit 850 is supported through engagement with one or more upright corner posts 804 of the child containment device frame 802, for example attached at medial portions of the corner posts between upper and lower ends thereof. In the depicted embodiment, the second child support unit 870 is coupled to or supported on a raised bassinet mattress 840 in a first mode of use. The second child support unit 870 is configured to also be used on an external support surface independent of the child containment device frame 802 in a second mode of use.

Figure 14B:
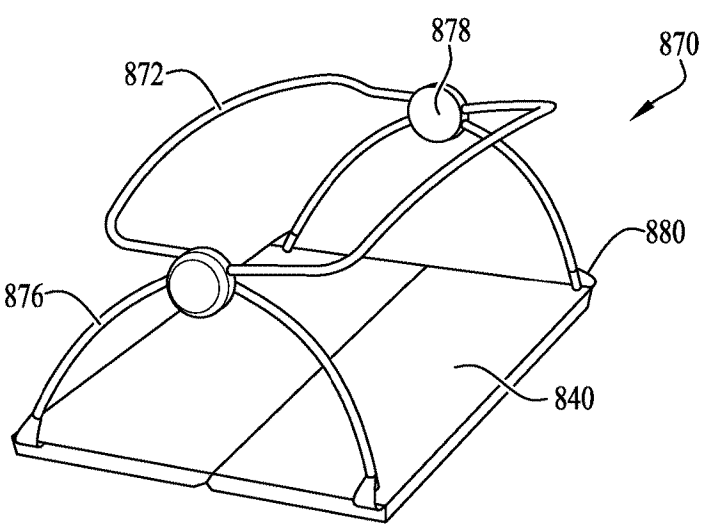
FIG. 14B shows a perspective view of a child support unit of the child support system of FIG. 14A, according to an example embodiment.
Figure 14D:
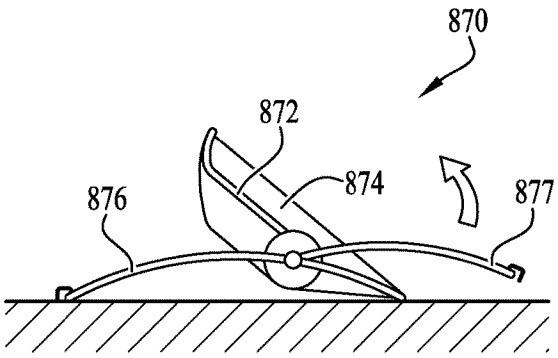
FIG. 14D shows a side view of the child support unit of FIG. 14B in an alternate configuration.
Figure 14A:
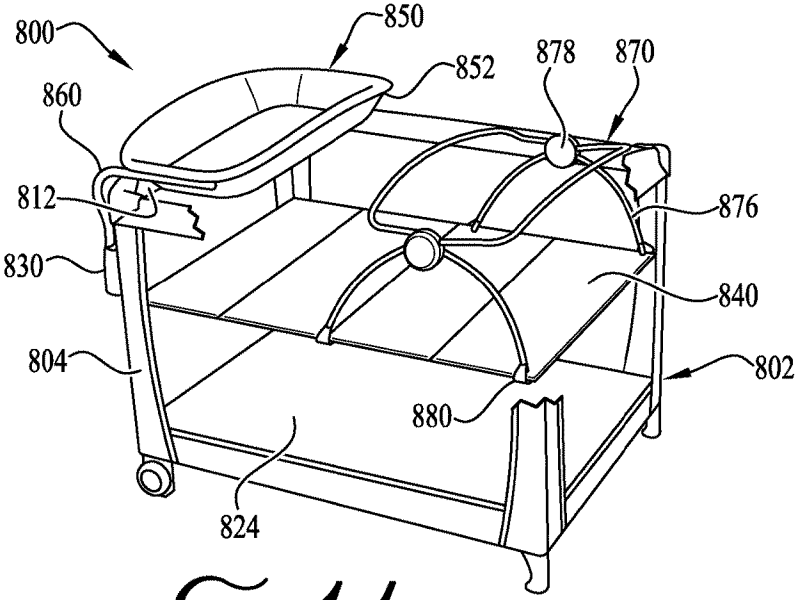
FIG. 14A is a cut-away perspective view of a child support system with a child containment device and child support units according to an example embodiment of the invention.

As shown in FIG. 14A, the first child support unit 850 is mounted to the frame 802 with two mounting attachments 830 such as sleeves or collars and L-shaped mounting bars 860 attached to or engaged with the mounting attachments. The first child support unit 850 is configured such that its length is parallel with the end cross-members 812 of the frame 802. The first end of the each mounting bar 860 is secured to the first child support unit subframe 852. The second end of the each mounting bar 860 engages with one of the mounting attachments 830 that are each affixed to an upright corner post 804 of the frame 802, for example at medial portions of the corner posts between upper and lower ends thereof.

The second child support unit 870 of the present embodiment generally includes a subframe 872 with one or more subframe components comprising a generally rectangular periphery for supporting soft goods 874 designed to support and contain the child when sleeping or resting. The second child support unit 870 is supported by one or more support members 876 configured to releasably engage the bassinet mattress 840 or other support surface. In the depicted embodiment, the support members 876 are four support legs extending downward from the subframe 872. The support members 876 are attached to the subframe 872 at attachment hubs 878. In the depicted embodiment, each end of the subframe 872 includes an attachment hub 878. Two support members 876 are attached at their proximal end to each attachment hub 878. In the example embodiment, the distal end of each support member 876 includes an attachment member 880, for releasably engaging the bassinet mattress 840. For example, each support member 876 can include a clip 880 configured to engage the peripheral edge of the bassinet mattress 840. In alternate embodiments, the attachment member can include snaps, buttons, hook-and-loop fasteners or another attachment means. In the depicted embodiment, the second child support unit 870 is attached to the mattress such that its length is parallel to the end cross-members 812 of the frame 802 and the clips 880 engage the sides of the outer periphery of the bassinet mattress 840. In other embodiments, the second child support unit is attached in an alternate configuration. In alternate embodiments, the second child support unit 870 is attached to the floor panel 824 of the child containment device or otherwise supported thereon. In example embodiments, the second child support unit 870 can be attached to the bassinet mattress 840 when the mattress is removed from the child containment device frame 802, as shown in FIG. 14B. In this configuration, the second child support unit 870 can be used independent of the child containment device frame 802 in a second alternative mode of use. In this mode of use, the bassinet mattress 840 is configured to rest on a support surface, such as the floor, or alternatively the ground or other support surface. In the depicted embodiment, the bassinet mattress 840 is folded to generally match the footprint of the second child support unit 870. In other embodiments, in the second mode of use, the second child support unit 870 is attached to or supported upon an external support surface 842, such as a play mat.

Figure 14C:
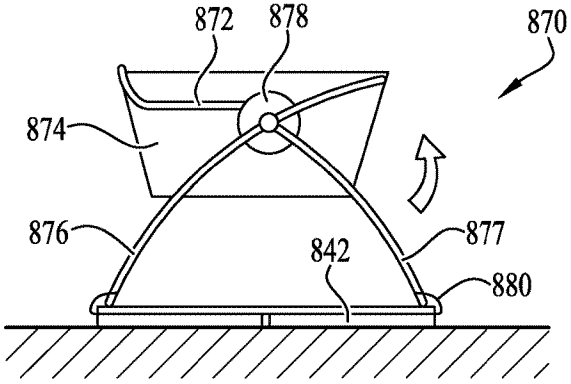
FIG. 14C shows a side view of the child support unit of FIG. 14B.

As shown in FIGS. 14C-D, the second child support unit 870 can also be configured to collapse into a compact or folded configuration for storage or transport. In the depicted embodiment, the support members 876 oriented on the same side of the subframe 872 are pivotally attached to the attachment hub 878. The pivoting support members 877 are configured to pivot relative to the subframe 872 while the other support members 876 remain fixed relative to the support frame. In alternate embodiments, all of the support members are configured to pivot relative to the subframe. In the depicted embodiment, the second child support unit 870 is folded after being detached from the external support surface 842 or raised bassinet mattress 840. In alternate embodiments, the second child support unit is configured to fold jointly with the support surface 842.

Figure 15B:
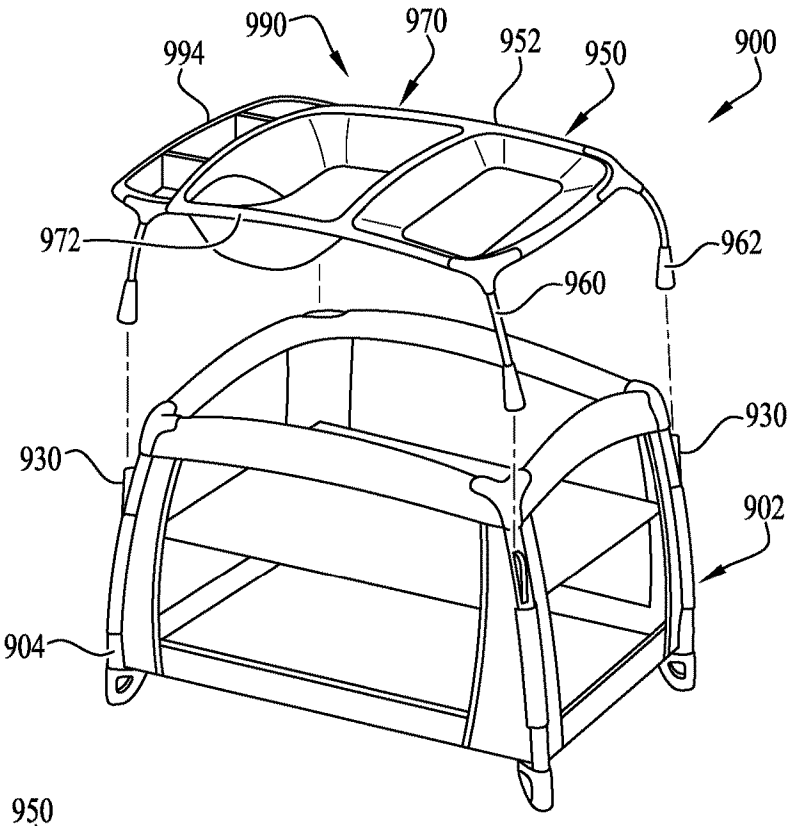
FIG. 15B shows an exploded view of the child support system of FIG. 15A.
Figure 15A:
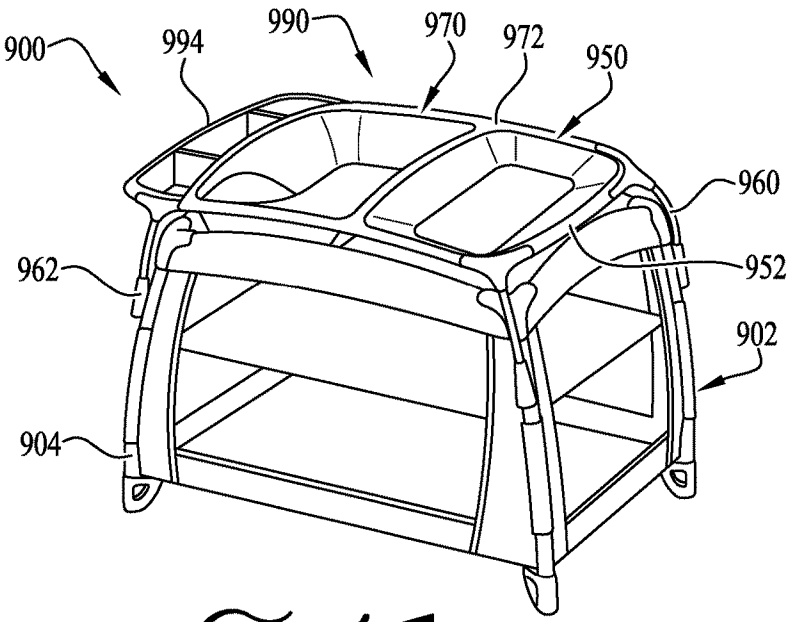
FIG. 15A is a perspective view of a child support system with a child containment device and child support unit according to another example embodiment of the invention.
Figure 15C:
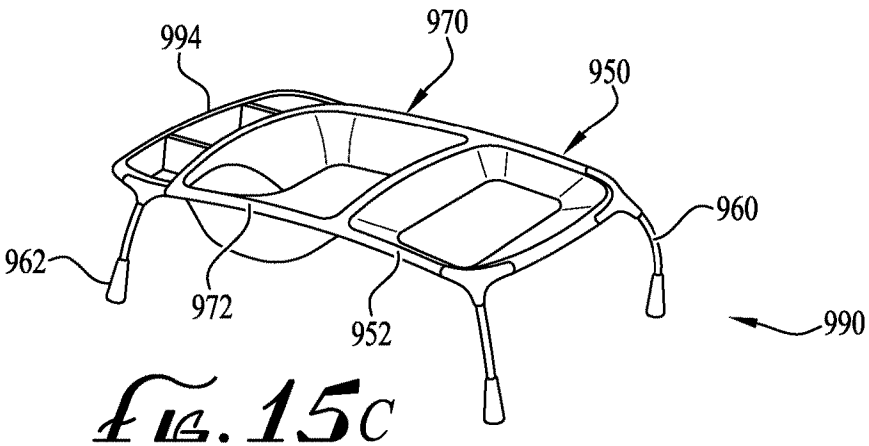
FIG. 15C shows a perspective view of the child support unit of FIG. 15A.

FIGS. 15A-C show a child support system 900 according to another example embodiment of the invention. In this embodiment, the first child support unit 950 and the second child support unit 970 are formed from a single child support unit frame 990. The child support unit frame 990 includes a first child support unit subframe 952 and the second child support unit subframe 972. The child support unit frame 990 can also include one or more accessory trays or bins 994 for holding toys, diaper supplies, pacifiers, or other things. In the depicted embodiment, the side of the first child support unit subframe 952 is coupled to the side of the second child support unit subframe 972. The accessory trays 994 are coupled to the opposite side of the second child support unit subframe 972 as the first child support unit subframe 952. In alternate embodiments, different arrangements of the subframes 952, 972 and accessory trays 994 are used.

The child support unit frame 990 is supported in a first mode of use through engagement with one or more upright corner posts 904 of the child containment device frame 902. In the depicted embodiment, the child support unit frame 990 is mounted to the frame 902 with four mounting attachments 930 and four mounting posts 960. The child support unit frame 990 is configured such that the length of each child support unit subframe 952, 972 is parallel with the end cross-members 912 of the frame 902. The upright corner posts 904 of the child containment device frame 902 each include a mounting attachment 930, positioned for example at a medial portion of the corner posts between upper and lower ends thereof. Each mounting post 960 has a first end attached to the child support unit frame 990 and a second end configured to engage with a corresponding mounting attachment 930. The second end of each mounting post 960 includes a foot 962 configured to releasably engage the respective mounting attachment 930. For example, the mounting attachments 930 optionally comprise outwardly projecting fins or flanges configured to be received and engaged within cooperating longitudinal slots or channels formed along inside faces of the feet 962. The mounting posts 960 and feet 962 are also configured to support the child support unit frame 990 on a support surface independent of the child containment device frame 902 in a second mode of use, as shown in FIG. 15C.

Figure 16B:
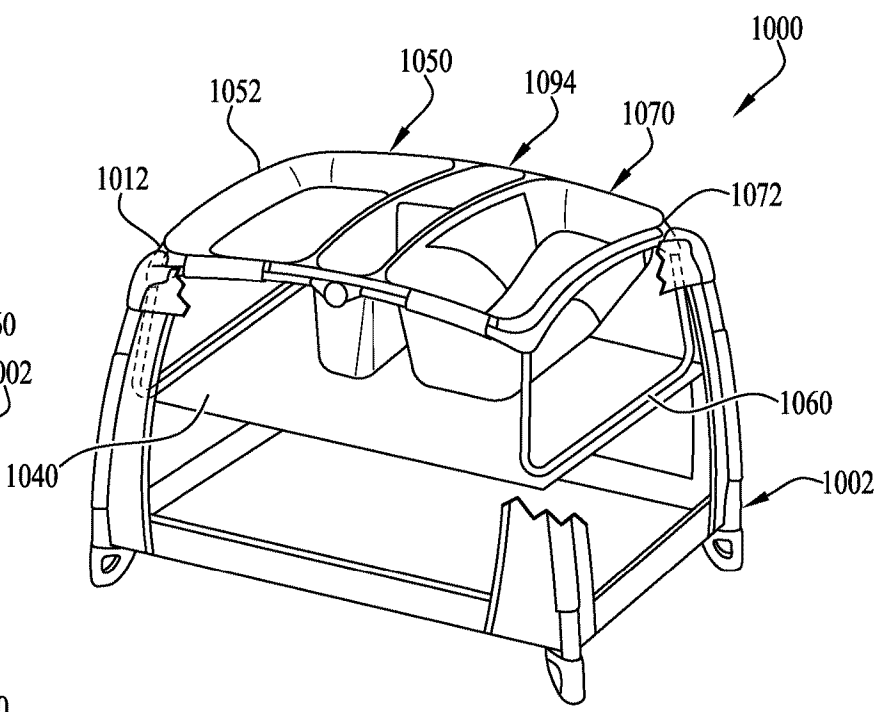
FIG. 16B shows a cut-away view of the child support unit of FIG. 16A.
Figure 16A:
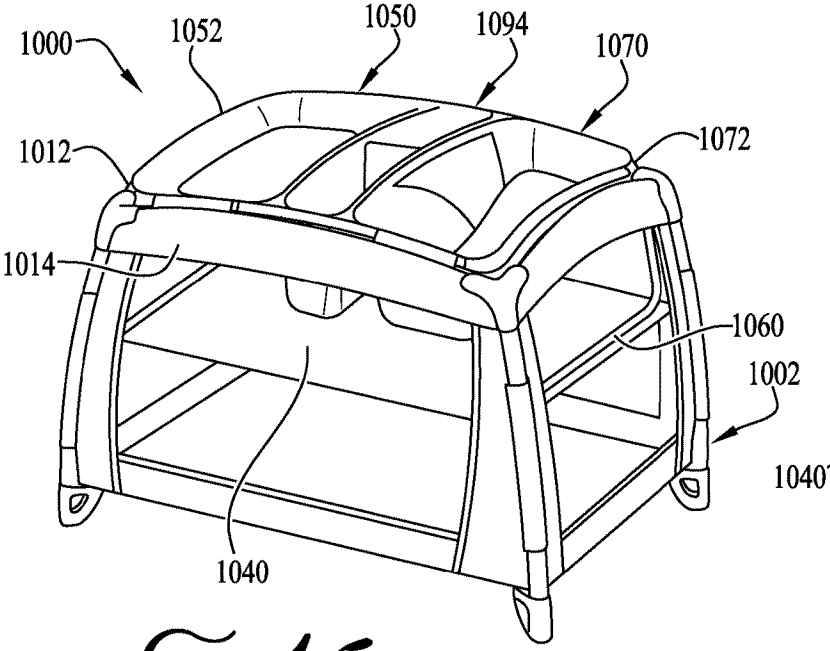
FIG. 16A is a perspective view of a child support system with a child containment device and a child support unit according to another example embodiment of the invention.
Figure 16C:
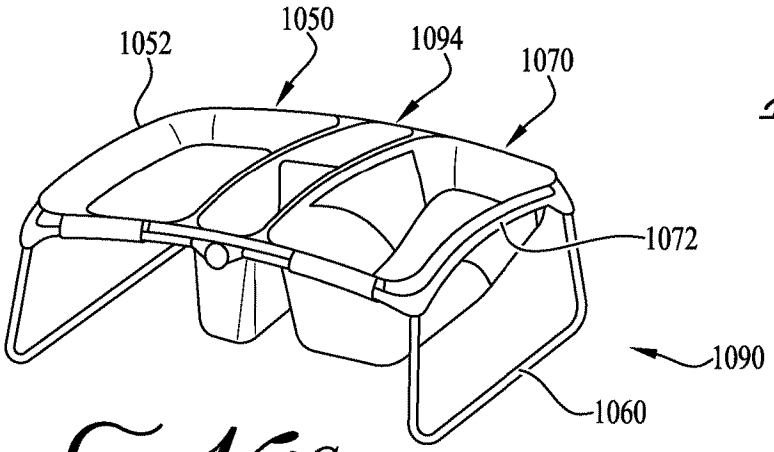
FIG. 16C shows a perspective view of the child support unit of FIG. 16A.
Figures 21A, 21B, 21C, 21D:
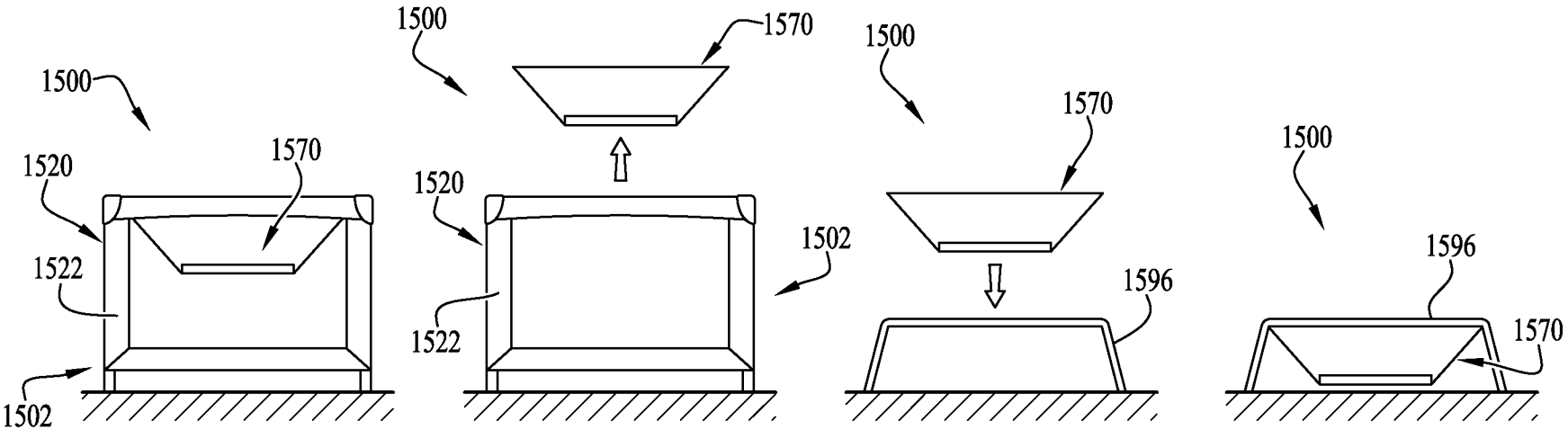
FIGS. 21A-D show side views of a child support system with a child containment device, child support unit and a support stand according to another example embodiment of the invention.
Figures 23A, 23B, 23C, 23D, 23E:
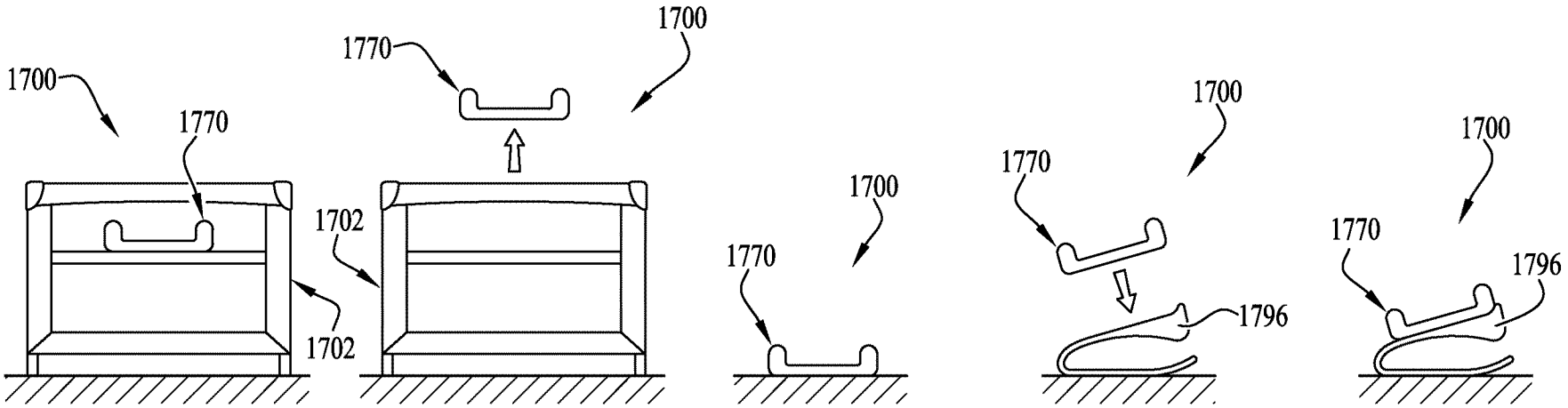
FIGS. 23A-E show side views of a child support system with a child containment device, child support unit and a support stand according to another example embodiment of the invention.
Figure 24A:
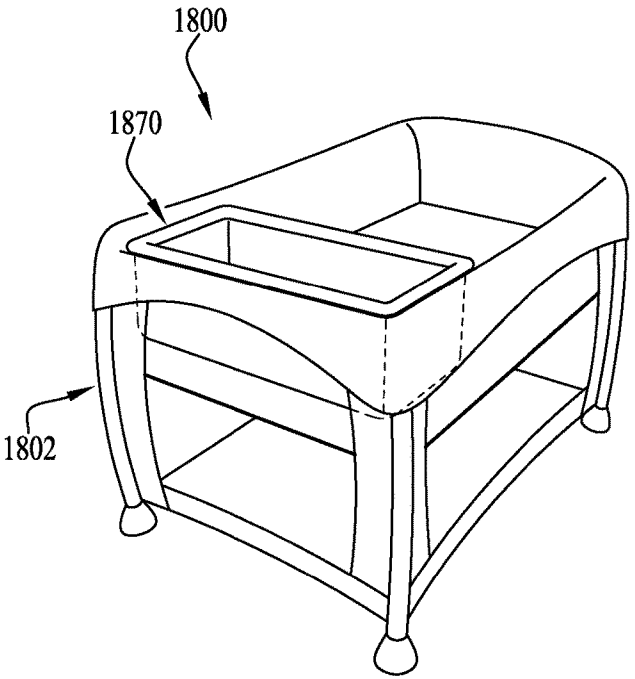
FIGS. 24A-D show a child support system with a child containment device, child support unit and a support stand according to another example embodiment of the invention.
Figure 24B:
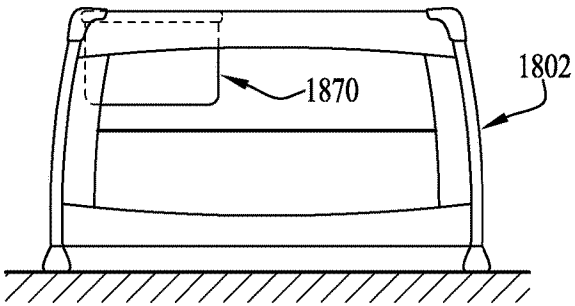
Figure 24C:
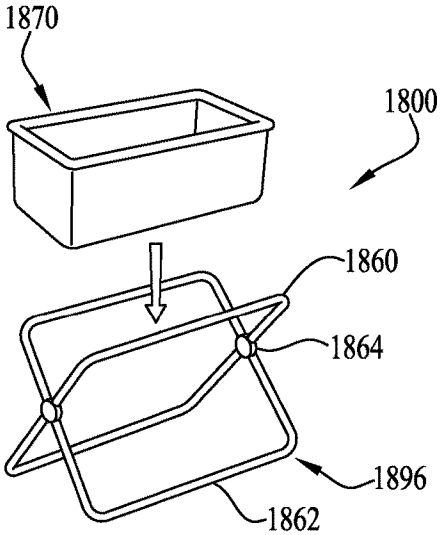
Figure 24D:
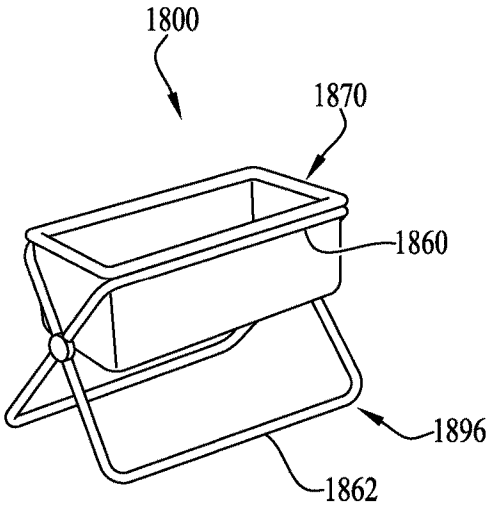

FIGS. 16A-C show a child support system 1000 according to another example embodiment of the invention. As in the previous embodiment, this child support system 1000 includes a single child support unit frame 1090 including both a first child support unit 1050 and a second child support unit 1070. The child support unit frame 1090 also includes one or more accessory trays or bins 1094 positioned in between the first child support unit subframe 1052 and the second child support unit subframe 1072. The child support unit frame 1090 is supported through engagement with the raised bassinet mattress 1040, or other support surface. In the depicted embodiment, the child support unit frame 1090 includes support members 1060 configured to engage with or rest upon the bassinet mattress 1040 in a first mode of use. Example support members 1060 include two U-shaped bars that have ends attached to the ends of the child support unit frame and a cross-bar configured to rest on bassinet mattress 1040. In other embodiments, other support member configurations can be used. In the example embodiment, the support members 1060 have a length such that they support the child support unit frame 1090 above the cross-members 1012, 1014 of the child containment device frame 1002. In alternate embodiments, the support members 1060 can support the child support unit frame 1090 at a different height. The support members 1060 can be configured to support the child support unit frame 1090 on a support surface independent of the child containment device frame 1002 in a second mode of use, as shown in FIG. 16C.

FIGS. 17A-D show a child support system 1100 according to another example embodiment of the invention. The child support system 1100 includes a child support unit 1170 configured to be releasably mounted to a child containment device frame 1102 in a first mode of use. In the example embodiment, the child support unit 1170 is mounted to the frame 1102 with two L-shaped mounting bars 1160, as shown in FIG. 17A. The first end of each mounting bar 1160 releasably engages the child support unit subframe 1172. In alternative embodiments, the child support unit 1170 is constructed of soft goods and the first end of each mounting bar 1160 attaches directly to the soft goods. For example, the first end of each mounting bar 1160 can be inserted into sleeves in the soft goods of the child support unit 1170. Other attachment methods can be used including snaps, buttons, zippers, hook-and-loop fasteners or other attachment methods. The second end of each mounting bar 1160 is attached to an upright corner post 1104 or other portion of the child containment device frame 1102. The mounting bars 1160 can be releasably or permanently attached to the frame 1102. The releasable attachment between the mounting bars 1160 and the second support unit subframe 1172 can include a sleeve mount, snaps, or another releasable attachment means. The child support unit 1170 can be detached from the mounting bars 1160, as shown in FIG. 17B. As shown in FIGS. 17C and 17D, the child support unit 1170 is configured for releasable attachment to a support stand 1196. The support stand 1196 is configured to support the child support unit 1170 above a support surface, independent of the child containment device frame 1102, in a second mode of use. The child support unit 1170 can comprise a changing table, a bassinet or cradle-like enclosure, or another type of child support device. The child support system 1100 can further include one or more additional child support units to be used in conjunction with the child support unit 1170 described above.

FIGS. 18A-C show a child support system 1200 according to another example embodiment of the invention. The child support system 1200 includes a child support unit 1270 releasably mounted to a child containment device frame 1202 in a first mode of use, similar to the previous embodiment 1100. In this embodiment, the L-shaped mounting bars 1260 are configured to detach from the upright corner posts 1204, as shown in FIG. 18B. The mounting bars 1260 are also configured for releasable attachment to a support stand 1296 in a second mode of use independent of the child containment device frame 1202. The support stand 1296 is configured to support the child support unit 1270 above a support surface, independent of the child containment device. The support stand 1296 can comprise a relatively flat pad or board, for example having one or more receivers or couplings configured to receive the second end of the mounting bars 1260. In alternate embodiments, the support stand 1296 comprises a frame configured to support the mounting bars 1260 and child support unit 1270 on a support surface. The support stand frame can comprise a U-shaped or rectangular frame member that rests on the support surface. The child support system can also include a raised bassinet mattress 1240.

FIGS. 19A-D show a child support system 1300 according to another example embodiment of the invention. The child support system 1300 includes a child support unit 1370 releasably mounted to a child containment device frame 1302, similar to the previous embodiment 1200. In this embodiment, the support stand 1396 comprises a raised portion 1398 configured to engage the second end of the mounting bars 1360. The support stand 1396 is configured to support the child containment device 1370 at a further distance above the support surface than the support stand 1296 of the previous embodiment 1200.

FIGS. 20A-C show a child support system 1400 according to another example embodiment of the invention. The child support system includes a child support unit 1470 attached to a height adjustable support stand 1496 configured for use with a child containment device frame 1402 in a first mode of use, and independent of the child containment device frame in a second mode of use. The support stand of the depicted embodiment includes an L-shaped mounting bar 1460 and an L-shaped base 1462. The first end of the mounting bar 1460 is attached to the subframe 1472 of the child support unit 1470. The second end of the mounting bar 1460 is inserted into the first end of the base 1462. The height of the child support unit 1470 is adjusted by adjusting the portion of the mounting bar 1460 within the base 1462. The second end of the base 1462 is configured to rest on a support surface. When used with a child containment device frame 1402, the support stand 1496 is adjusted so that the child support unit 1470 is supported at a height above the frame. The second end of the base 1462 is configured to slide underneath the frame 1402 so that the child support unit 1470 is positioned over the child containment device. When the stand 1496 is used independent of the child containment device frame 1402, it can be adjusted to a lower height, as shown in FIG. 20C.

FIGS. 21A-D show a child support system 1500 according to another example embodiment of the invention. The child support system 1500 includes a child support unit 1570 releasably mounted to a child containment device frame 1502 for use with an independent support stand 1596, as in previous embodiments 1200, 1300. In the depicted embodiment, the child support unit 1570 is removably attached to the interior of the sidewalls 1522 of the child containment device liner 1520. The child support unit 1570 can be attached to the liner 1520 with fasteners such as zippers, snaps clips, buttons, hook-and-loop material or the like. The child support unit 1570 is also configured for releasable attachment with a support stand 1596. The support stand 1596 is configured to support the child support unit 1570 above a support surface, independent of the child containment device frame 1502.

FIGS. 22A-E show a child support system 1600 according to another example embodiment of the invention. The child support system 1600 includes a child support unit 1670 configured to be releasably mounted to a child containment device frame 1602 in a first mode of use, and to a separate support stand 1696 in a second mode of use independent of the child containment device frame. In this embodiment, the child support unit 1670 is configured for at least three modes of use. First, the child support unit 1670 can be releasably mounted to the child containment device frame, as shown in FIG. 22A. The child support unit 1670 can be mounted to the frame, like in previously described embodiments, or the child support unit can rest on a raised bassinet surface or floor panel 1624. The child support unit 1670 is also configured for use when resting directly on a support surface independent of the child containment device frame 1602. The child support unit 1670 can include a subframe 1672 configured to create walls sufficient to contain an infant when the child support unit is resting on a support surface, like the floor. The child support unit 1670 can also be used with a separate support stand 1696. The support stand 1696 can comprise a platform configured to support the child support unit 1670 above the support surface. In example embodiments, the support stand 1696 includes radiused lower support surfaces or rockers, allowing the stand to pivot in a rocking motion.

FIGS. 23A-E show a child support system 1700 according to another example embodiment of the invention. The child support system 1700 includes a child support unit 1770 releasably engaged with a child containment device frame 1702 and a separate support stand 1796, as in the previous embodiment. The child support unit 1770 can releasably attach to the child containment device frame 1702 and/or can rest on a support surface within the child containment area, such as the floor panel or a raised bassinet mattress. In the depicted embodiment, the support stand 1796 includes an inclined receiving surface for receiving the child support unit 1770. The support stand 1796 is configured to support the child support unit 1770 at an angle relative to the support surface. In example embodiments, the support stand 1796 is constructed of a resilient flexible material, allowing the support stand to be used as a bouncer.

FIGS. 24A-D show a child support system 1800 according to another example embodiment of the invention. The child support system 1800 includes a child support unit 1870 configured to be releasably engaged with a child containment device frame 1802 and with a separate support stand 1896, as in the previous embodiments. In the depicted embodiment, the support stand 1896 includes two mounting U-shaped portions 1860 and two base U-shaped portions 1862. The mounting portions 1860 are configured to attach to the child support unit 1870. The base portions 1862 are configured to engage with a support surface. The cross-bars of the base portions 1862 can be curved such that the stand can rock on the support surface. The mounting portions 1860 and base portions 1862 attach at hubs 1864 positioned at the ends of the stand 1896 to form an X-shaped stand. The hubs can be designed to pivot such that the stand 1896 can be folded for storage.

In its various embodiments, the child support system of the present invention enables methods of use by an adult caregiver to support a child in one or more positions or intended applications, in connection with a play yard, crib, playpen or other child containment apparatus. In example embodiments, the method includes mounting a first child support unit to the play yard or other child containment apparatus in a first position and for use in a first intended application. For example, the first child support unit may be attached at a first end of a play yard over the containment space of the play yard, for example supported by attachment to corner posts of the play yard, for use as a changing table for diapering or dressing an infant or small child. In example embodiments, the method further includes mounting a second child support unit to the play yard or other child containment apparatus in a second position and for use in a second intended application. For example, the second child support unit may be attached at a middle area or over an opposite second end of the play yard over the containment space of the play yard, for example supported by attachment on one side or end to the first child support unit and supported on the other side or end by the play yard, for use as a sleeper or small bassinet for receiving an infant or small child. In example embodiments, the method includes use of the first child support unit independently in connection with the play yard, with or without the second child support unit. In example embodiments, the method further includes use of the second child support unit in connection with the play yard and only with the first child support unit (i.e., not configured for independent use of the second child support unit); or alternatively permitting use of the second child support unit with or without the first child support unit. In example embodiments, the method further comprises removal of the second child support unit, and/or removal of the first child support unit, from the play yard for improved access to the main containment area of the play yard, and optionally folding or retracting a support element of one or both of the first and second child support units from an extended use position to a retracted or compact storage position.

In other example embodiments, the method includes releasably mounting a first and/or second child support unit to the play yard or other child containment apparatus in a first mode of use, and using the child support unit independently of the play yard or other child containment apparatus in a second mode of use. For example, the child support unit may be attached at an end of a play yard over the containment space of the play yard, for example supported by attachment to corner posts of the play yard, for use as a bassinet. In other embodiments, the child support unit is configured to rest on the floor panel or a raised bassinet mattress of the play yard. In example embodiments, the method includes detaching or removing the child support unit from the play yard for use independent of the play yard. In example embodiments, child support unit is configured to rest directly on a support surface. In other embodiments, a support stand, separate from the child containment device, is used to support the child support unit above a support surface. In other embodiments, portions of the apparatus used to mount the child support unit to the child containment device are also used to support the child support unit above a support surface independent of the child containment device. In example embodiments, one, two or more child support units are provided for use in combination with, and/or use independently of, a play yard or other child containment apparatus. In alternate embodiments, a first child support unit and a second child support unit are connected to a single frame or otherwise coupled together, and can be coupled to and/or removed from the play yard as a consolidated unit. In still further embodiments, a first child support unit and a second child support unit are configured for separate and independent attachment to and/or removal from the play yard.

While the invention has been described with reference to preferred and example embodiments, it will be understood by those skilled in the art that a variety of modifications, additions and deletions are within the scope of the invention, as defined by the following claims.

What is claimed is:

1. A child support system comprising:

a child containment device defining a containment space bounded by at least one sidewall, one or more side-cross members, and a floor;

a first child support unit configured for a first mode of use in connection with the child containment device and supported through engagement with the one or more side-cross members, the first child support unit including one or more mounting bars and one or more detachable couplings; and a second child support unit configured for a second mode of use supported through engagement with the one or more mounting bars of the first child support unit;

wherein the second child support unit is releasably mounted to the one or more mounting bars of the first child support unit, the one or more mounting bars are releasably attached to the one or more detachable couplings, and the one or more detachable couplings are releasably attached to the one or more side-cross members of the child containment device.

2. The child support system of claim 1, wherein the child containment device is a children's play yard comprising four sidewalls and defining a generally rectangular containment space.

3. The child support system of claim 1, wherein the first child support unit is supported by removable attachment to corner posts of the child containment device.

4. The child support system of claim 1, wherein the first child support unit is supported by resting on the floor of the child containment device.

5. The child support system of claim 1, wherein the child containment device further comprises a raised bassinet mattress.

6. The child support system of claim 5, wherein the first child support unit is supported by resting on the raised bassinet mattress of the child containment device.

7. The child support system of claim 5, wherein the first child support unit includes one or more support members configured to support the first child support unit a distance above the raised bassinet mattress.

8. The child support system of claim 1, wherein the first child support unit is configured for use when resting on a support surface independent of the child containment device.

9. The child support system of claim 8, wherein the first child support unit includes one or more support members configured to engage the support surface.

10. The child support system of claim 1, wherein the first child support unit is also supported by removable attachment to a support stand independent of the child containment device.

11. The child support system of claim 10, wherein the support stand comprises a rocker.

12. The child support system of claim 10, wherein the support stand comprises a bouncer.

13. The child support system of claim 1, wherein the first child support unit comprises an infant sleeper unit.

* * * * *